US009957924B2

(12) United States Patent
Dudar

(10) Patent No.: US 9,957,924 B2
(45) Date of Patent: May 1, 2018

(54) EVAPORATIVE EMISSIONS SYSTEM CHECK VALVE MONITOR FOR GTDI ENGINES

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days. days.

(21) Appl. No.: 15/225,662

(22) Filed: Aug. 1, 2016

(65) Prior Publication Data

US 2018/0030932 A1 Feb. 1, 2018

(51) Int. Cl.

| | |
|---|---|
| ***F02D 41/22*** | (2006.01) |
| ***F02M 25/08*** | (2006.01) |
| ***F02D 41/00*** | (2006.01) |
| ***F02D 41/26*** | (2006.01) |

(52) U.S. Cl.

CPC ..... *F02M 25/0809* (2013.01); *F02D 41/003* (2013.01); *F02D 41/221* (2013.01); *F02D 41/26* (2013.01); *F02M 25/0836* (2013.01); *F02M 25/0854* (2013.01)

(58) Field of Classification Search

CPC ..... F02M 25/0809; F02M 25/0854; F02M 25/0836; F02D 41/26; F02D 41/003; F02D 41/221; F02D 41/22; F02D 2041/224

USPC ..... 701/103–105, 107; 123/518–520; 73/114.39

See application file for complete search history.

(56) References Cited

U.S. PATENT DOCUMENTS

| | | | | |
|---|---|---|---|---|
| 8,725,347 | B2 * | 5/2014 | Jentz | G01M 3/025 180/441 |
| 2010/0224171 | A1 | 9/2010 | Peters et al. | |
| 2013/0220282 | A1 | 8/2013 | Hadre et al. | |
| 2013/0253799 | A1 | 9/2013 | Peters et al. | |
| 2014/0251284 | A1 | 9/2014 | Plymale et al. | |

* cited by examiner

*Primary Examiner* — Hai Huynh

(74) *Attorney, Agent, or Firm* — James Dottavio; McCoy Russell LLP

(57) ABSTRACT

Methods and systems are provided for conducting a dual test monitor for the presence or absence of undesired evaporative emissions in a vehicle fuel system and evaporative emissions control system. In one example, the dual test monitor includes conducting an evaporative emissions test diagnostic procedure during both boosted and non-boosted conditions during a single drive cycle. In this way, results from the test diagnostic procedure conducted under boost conditions may be compared to the results of the test diagnostic procedure under non-boosted conditions, to unambiguously diagnose functionality of a plurality of components in the fuel system and evaporative emissions system, which may thus reduce undesired evaporative emissions.

19 Claims, 8 Drawing Sheets

FIG. 5

500

| | Vac threshold reached under boost? | Vac threshold reached under natural aspiration? | Diagnosis |
|---|---|---|---|
| A | Yes | Yes | CV1, CV2 not stuck closed and no gross undesired emissions |
| B | No | No | CV1, CV2 not stuck closed and gross undesired emissions present |
| C | Yes | No | CV2 not stuck closed, CV1 stuck closed and no gross undesired emissions present |
| D | No | Yes | CV2 stuck closed, CV1 not stuck closed and no gross undesired emissions present |

EVAPORATIVE EMISSIONS SYSTEM CHECK VALVE MONITOR FOR GTDI ENGINES

FIELD

The present description relates generally to methods and systems for controlling flow and diagnosing components in a fuel vapor recovery system for a vehicle with a boosted internal combustion engine.

BACKGROUND/SUMMARY

Vehicles may be fitted with evaporative emission control systems such as onboard fuel vapor recovery systems. Such systems capture and prevent release of vaporized hydrocarbons to the atmosphere, for example fuel vapors generated in a vehicle gasoline tank during refueling. Specifically, the vaporized hydrocarbons (HCs) are stored in a fuel vapor canister packed with an adsorbent which adsorbs and stores the vapors. At a later time, when the engine is in operation, the evaporative emission control system allows the vapors to be purged into the engine intake manifold for use as fuel. The fuel vapor recovery system may include one more check valves, ejectors, and/or controller actuatable valves for facilitating purge of stored vapors under boosted or non-boosted engine operation.

Various approaches have been developed for detecting undesired fuel vapor evaporative emissions and/or degraded components in such fuel vapor recovery systems. However, the inventors have recognized several potential issues with such methods. The inventors have recognized that, in particular, it may be difficult to diagnose one or more check valves positioned in the evaporative emissions control system, during vehicle operation under boosted or non-boosted conditions. For example, under non-boosted conditions (e.g., natural aspiration), it may be difficult to determine if a first check valve positioned downstream of a canister purge valve (CPV) and upstream of an intake manifold of the engine is stuck closed, or if gross undesired evaporative emissions (e.g., orifice diameter of 0.04" or greater) are present in the evaporative emissions control system. Furthermore, under boosted conditions, it may similarly be difficult to determine if a second check valve positioned downstream of the CPV and upstream of an ejector and intake passage, is stuck closed, or if gross undesired evaporative emissions are present in the evaporative emissions control system. More specifically, a stuck closed first check valve may be incorrectly interpreted as gross undesired evaporative emissions under non-boosted conditions. Alternatively, under boosted conditions, gross undesired evaporative emissions may be incorrectly interpreted as a stuck closed second check valve.

Thus, the inventors herein have developed systems and methods to at least partially address the above issues. In one example a method is provided, comprising evacuating a fuel system, including a fuel tank that supplies fuel to an engine, and an evaporative emissions system, including a fuel vapor storage canister for storing vapors from the tank, under a first condition and a second condition during a single drive cycle; and diagnosing a plurality of fuel system and evaporative emissions system components based on a vacuum level reached during both the first and second conditions.

As one example, the first condition may include pressure in an intake manifold of the engine less than barometric pressure, and the second condition may include pressure in the intake manifold of the engine greater than barometric pressure. As such, evacuating the fuel system and evaporative emissions system may include communicatively coupling the fuel system and evaporative emissions system to the intake manifold of the engine in the first condition, and communicatively coupling the fuel system and evaporative emissions system to an ejector in an ejector system of the vehicle, where the ejector functions to generate negative pressure in the fuel system and evaporative emissions system, in the second condition. Evacuating the fuel system and evaporative emissions system may further include sealing the fuel system and evaporative emissions system from atmosphere in both the first condition and the second condition.

In some examples, communicatively coupling the fuel system and evaporative emissions system to the intake manifold in the first condition, and communicatively coupling the fuel system and evaporative emissions system to the ejector in the second conditions may further include commanding open a canister purge valve positioned downstream of the fuel vapor canister, and upstream of both the ejector and the intake manifold of the engine. Furthermore, communicatively coupling the fuel system and evaporative emissions system to the intake manifold in the first condition may include opening a vacuum-actuated first check valve positioned upstream of the intake manifold, and communicatively coupling the fuel system and evaporative emissions system to the ejector in the second condition includes opening a vacuum-actuated second check valve positioned upstream of the ejector. As such, diagnosing the plurality of fuel system and evaporative emissions system components based on the vacuum level reached during both the first and second conditions may include diagnosing both the first check valve and the second check valve.

Specifically, responsive to the vacuum level reaching a predetermined threshold vacuum level in the first condition, a first check valve may be indicated to not be stuck closed, and responsive to the vacuum level reaching the predetermined threshold vacuum level in the second condition, the second check valve may be indicated to not be stuck closed. In another example, responsive to the vacuum level reaching the predetermined vacuum level in only one condition, it may be indicated that one check valve is stuck closed, and it may be further indicated that there is an absence of gross undesired evaporative emissions in the fuel system and evaporative emissions system. In other words, responsive to the vacuum level reaching the predetermined vacuum level in at least one of the first condition and the second condition, an absence of gross undesired evaporative emissions in the fuel system and evaporative emissions system may be indicated. However, responsive to the vacuum level reaching the predetermined vacuum level in only one condition, it may be indicated that one check valve is stuck substantially closed. In this way, by evacuating the fuel system and evaporative emissions system under both the first condition and the second condition in a single drive cycle, both the first check valve and the second check valve, along with the presence or absence of undesired evaporative emissions, may be indicated. Specifically diagnosing the check valves and the fuel system and evaporative emissions system may thus lead to reduced undesired evaporative emissions and improved engine operation.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 5 shows a chart illustrating potential outcomes and resultant diagnosis of evaporative emissions test diagnostic procedures conducting according to the method of FIG. 5, and with regard to the methods of FIG. 2 and FIG. 3.

DETAILED DESCRIPTION

Figure 7:
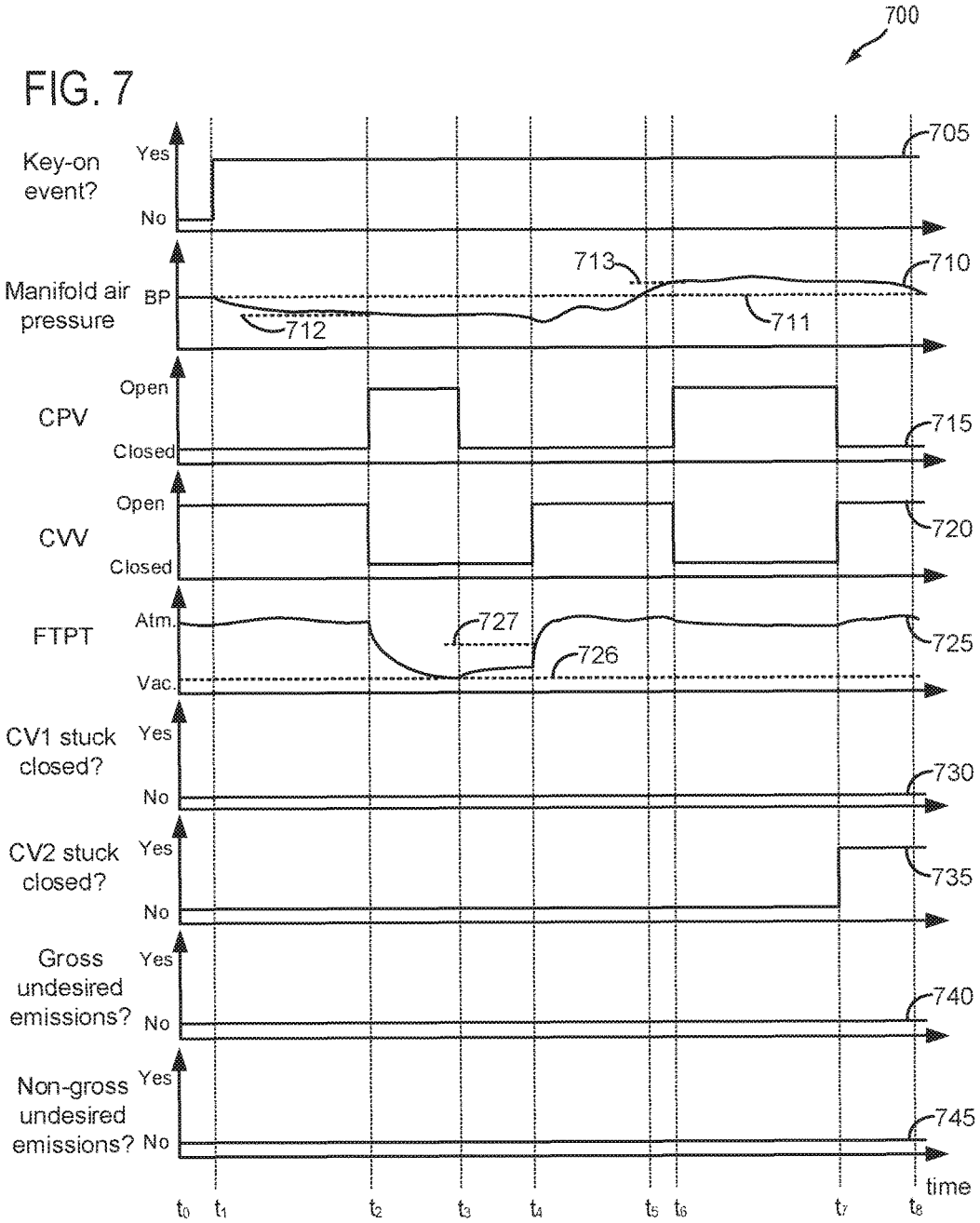
FIG. 7 shows an example timeline for conducting an evaporative emissions test diagnostic procedure under both boost conditions and natural aspiration conditions in the same drive cycle, according to the method of FIG. 4.
Figure 8:
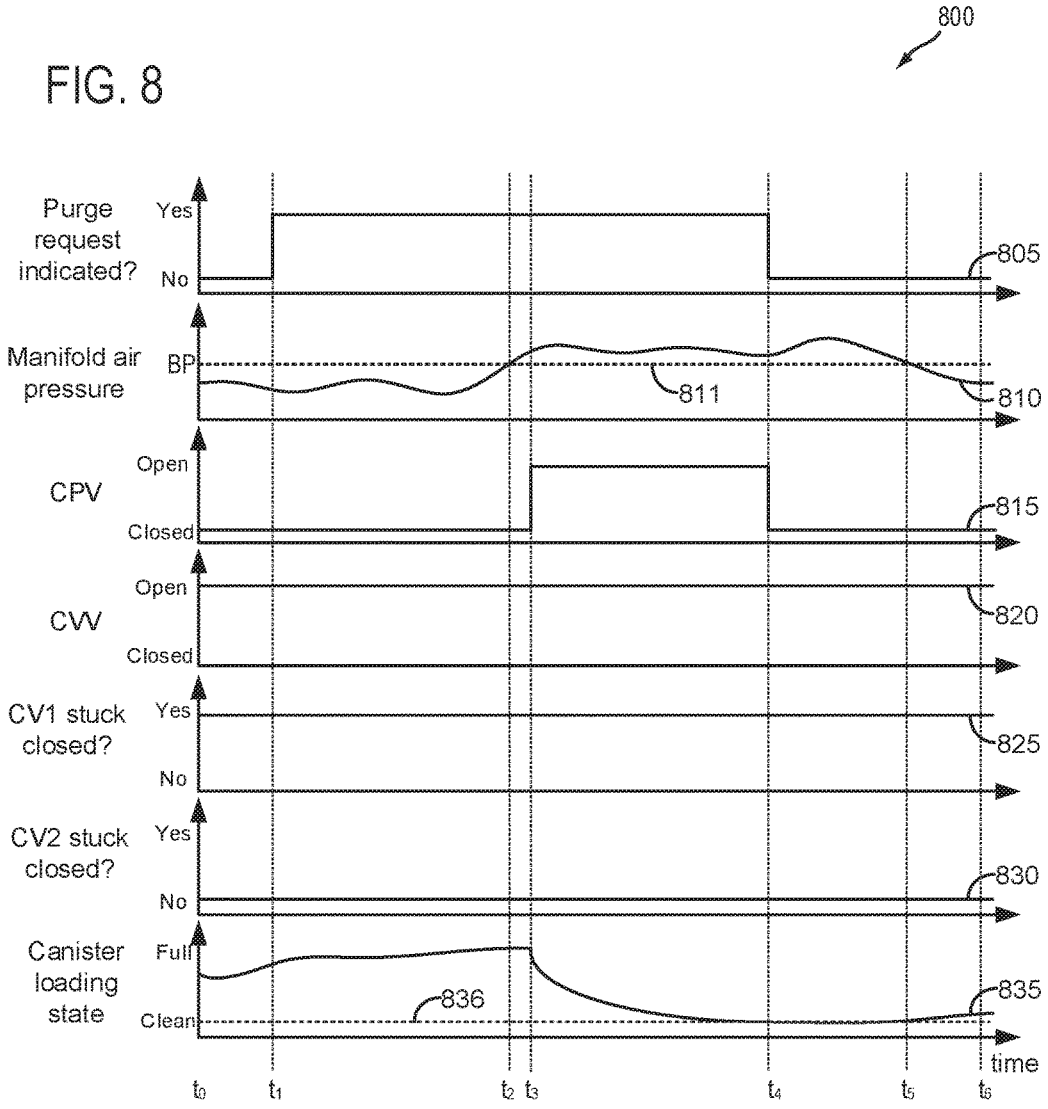
FIG. 8 shows an example timeline for conducting a purging event under conditions where one of a first check valve or a second check valve positioned in an evaporative emissions system is indicated to be stuck closed, according to the method of FIG. 6.

The following description relates to systems and methods for diagnosing the presence or absence of undesired evaporative emissions in a fuel system and evaporative emissions system of a boosted vehicle system, and further relates to diagnosing a plurality of components in said evaporative emissions system. The systems and methods may be used to diagnose check valves, for example, such as the check valves positioned within the evaporative emissions system depicted in the boosted engine vehicle system depicted in FIG. 1. An evaporative emissions test diagnostic procedure may be conducted under boosted engine operation, according to the method illustrated in FIG. 2. Alternatively, an evaporative emissions test diagnostic procedure may be conducted under natural aspiration (e.g., intake manifold vacuum) conditions, according to the method illustrated in FIG. 3. In a single drive cycle, a dual test monitor may be conducted, wherein an evaporative emissions test diagnostic may be conducted under both boost conditions, and under natural aspiration conditions, according to the method illustrated in FIG. 4. Such a dual test monitor may enable diagnosing a first check valve, positioned between a canister purge valve and engine intake, diagnosing a second check valve, positioned between the canister purge valve and an ejector, and indicating the presence or absence of undesired evaporative emissions in the fuel system and evaporative emissions system. For example, responsive to conducting the dual test monitor, the results of the tests may be interpreted via a lookup table, such as the lookup table depicted in FIG. 5. Based on the results of the dual-test monitor, fuel vapor canister purging operations of a fuel vapor storage canister positioned in the evaporative emissions system may be modified according to the method depicted in FIG. 6. An example timeline for conducting the dual test monitor, according to the method depicted in FIG. 4, is illustrated in FIG. 7. An example timeline for conducting purging operations responsive to results of the dual test monitor, is illustrated in FIG. 8.

Figure 1:
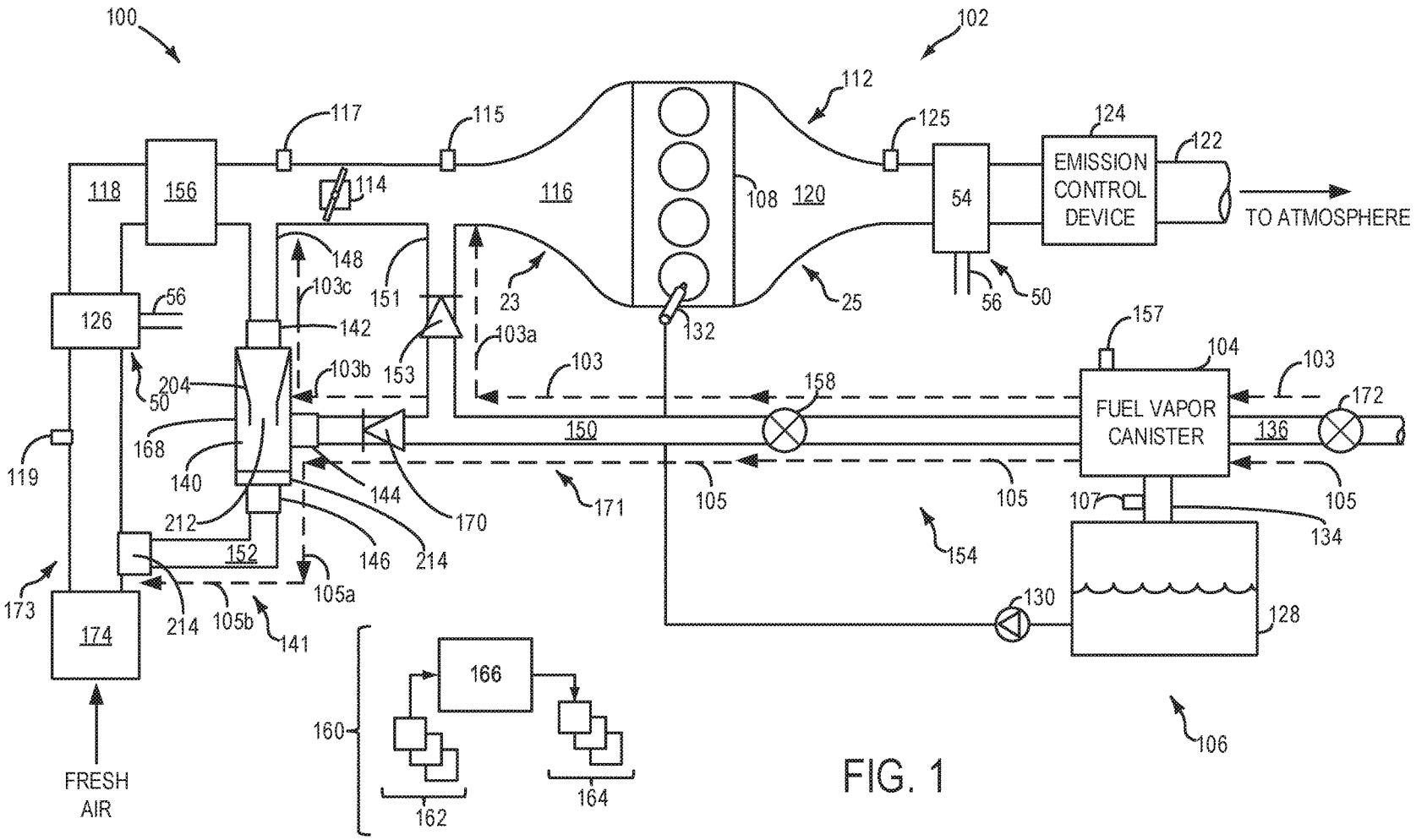
FIG. 1 shows a schematic diagram of a multi-path fuel vapor recovery system of a vehicle system.

Turning to the figures, FIG. 1 shows a schematic depiction of a vehicle system 100. The vehicle system 100 includes an engine system 102 coupled to a fuel vapor recovery system (evaporative emissions control system) 154 and a fuel system 106. The engine system 102 may include an engine 112 having a plurality of cylinders 108. The engine 112 includes an engine intake 23 and an engine exhaust 25. The engine intake 23 includes a throttle 114 fluidly coupled to the engine intake manifold 116 via an intake passage 118. An air filter 174 is positioned upstream of throttle 114 in intake passage 118. The engine exhaust 25 includes an exhaust manifold 120 leading to an exhaust passage 122 that routes exhaust gas to the atmosphere. The engine exhaust 122 may include one or more emission control devices 124, which may be mounted in a close-coupled position in the exhaust. One or more emission control devices may include a three-way catalyst, lean NOx trap, diesel particulate filter, oxidation catalyst, etc. It will be appreciated that other components may be included in the vehicle system, such as a variety of valves and sensors, as further elaborated below.

Throttle 114 may be located in intake passage 118 downstream of a compressor 126 of a boosting device, such as turbocharger 50, or a supercharger. Compressor 126 of turbocharger 50 may be arranged between air filter 174 and throttle 114 in intake passage 118. Compressor 126 may be at least partially powered by exhaust turbine 54, arranged between exhaust manifold 120 and emission control device 124 in exhaust passage 122. Compressor 126 may be coupled to exhaust turbine 54 via shaft 56. Compressor 126 may be configured to draw in intake air at atmospheric air pressure into an air induction system (AIS) 173 and boost it to a higher pressure. Using the boosted intake air, a boosted engine operation may be performed.

An amount of boost may be controlled, at least in part, by controlling an amount of exhaust gas directed through exhaust turbine 54. In one example, when a larger amount of boost is requested, a larger amount of exhaust gases may be directed through the turbine. Alternatively, for example when a smaller amount of boost is requested, some or all of the exhaust gas may bypass turbine via a turbine bypass passage as controlled by wastegate (not shown). An amount of boost may additionally or optionally be controlled by controlling an amount of intake air directed through compressor 126. Controller 166 may adjust an amount of intake air that is drawn through compressor 126 by adjusting the position of a compressor bypass valve (not shown). In one example, when a larger amount of boost is requested, a smaller amount of intake air may be directed through the compressor bypass passage.

Fuel system 106 may include a fuel tank 128 coupled to a fuel pump system 130. The fuel pump system 130 may include one or more pumps for pressurizing fuel delivered to fuel injectors 132 of engine 112. While only a single fuel injector 132 is shown, additional injectors may be provided for each cylinder. For example, engine 112 may be a direct injection gasoline engine and additional injectors may be provided for each cylinder. It will be appreciated that fuel system 106 may be a return-less fuel system, a return fuel system, or various other types of fuel system. In some examples, a fuel pump may be configured to draw the tank's liquid from the tank bottom. Vapors generated in fuel system 106 may be routed to fuel vapor recovery system (evaporative emissions control system) 154, described further below, via conduit 134, before being purged to the engine intake 23.

Fuel vapor recovery system 154 includes a fuel vapor retaining device, depicted herein as fuel vapor canister 104. Canister 104 may be filled with an adsorbent capable of binding large quantities of vaporized HCs. In one example, the adsorbent used is activated charcoal. Canister 104 may receive fuel vapors from fuel tank 128 through conduit 134. While the depicted example shows a single canister, it will be appreciated that in alternate embodiments, a plurality of such canisters may be connected together. Canister 104 may communicate with the atmosphere through vent 136. In some examples, a canister vent valve 172 may be located along vent 136, coupled between the fuel vapor canister and the atmosphere, and may adjust a flow of air and vapors between canister 104 and the atmosphere. However, in other examples, a canister vent valve may not be included. In one example, operation of canister vent valve 172 may be regulated by a canister vent solenoid (not shown). For example, based on whether the canister is to be purged or not, the canister vent valve may be opened or closed. In some examples, an evaporative level check monitor (ELCM) (not shown) may be disposed in vent 136 and may be configured to control venting and/or assist in detection of undesired evaporative emissions. Furthermore, in some examples, one or more oxygen sensors may be positioned in the engine intake 116, or coupled to the canister 104 (e.g., downstream of the canister), to provide an estimate of canister load. In still further examples, one or more temperature sensors 157 may be coupled to and/or within canister 104. As will be discussed in further detail below, as fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister, and may be used to estimate canister load.

Conduit 134 may optionally include a fuel tank isolation valve (not shown). Among other functions, fuel tank isolation valve may allow the fuel vapor canister 104 to be maintained at a low pressure or vacuum without increasing the fuel evaporation rate from the tank (which would otherwise occur if the fuel tank pressure were lowered). The fuel tank 128 may hold a plurality of fuel blends, including fuel with a range of alcohol concentrations, such as various gasoline-ethanol blends, including E10, E85, gasoline, etc., and combinations thereof.

Fuel vapor recovery system 154 may include a dual path purge system 171. Purge system 171 is coupled to canister 104 via a conduit 150. Conduit 150 may include a canister purge valve (CPV) 158 disposed therein. Specifically, CPV 158 may regulate the flow of vapors along duct 150. The quantity and rate of vapors released by CPV 158 may be determined by the duty cycle of an associated CPV solenoid (not shown). In one example, the duty cycle of the CPV solenoid may be determined by controller 166 responsive to engine operating conditions, including, for example, an air-fuel ratio. By commanding the CPV to be closed, the controller may seal the fuel vapor canister from the fuel vapor purging system, such that no vapors are purged via the fuel vapor purging system. In contrast, by commanding the CPV to be open, the controller may enable the fuel vapor purging system to purge vapors from the fuel vapor canister.

Fuel vapor canister 104 operates to store vaporized hydrocarbons (HCs) from fuel system 106. Under some operating conditions, such as during refueling, fuel vapors present in the fuel tank may be displaced when liquid is added to the tank. The displaced air and/or fuel vapors may be routed from the fuel tank 128 to the fuel vapor canister 104, and then to the atmosphere through vent 136. In this way, an increased amount of vaporized HCs may be stored in fuel vapor canister 104. During a later engine operation, the stored vapors may be released back into the incoming air charge via fuel vapor purging system 171.

Conduit 150 is coupled to an ejector 140 in an ejector system 141 and includes a second check valve (CV2) 170 disposed therein between ejector 140 and CPV 158. Second check valve (CV2) 170 may prevent intake air from flowing through from the ejector into conduit 150, while allowing flow of air and fuel vapors from conduit 150 into ejector 140. CV2 170 may be a vacuum-actuated check valve, for example, that opens responsive to vacuum derived from ejector 140.

A conduit 151 couples conduit 150 to intake 23 at a position within conduit 150 between check valve 170 and CPV 158 and at a position in intake 23 downstream of throttle 114. For example, conduit 151 may be used to direct fuel vapors from canister 104 to intake 23 using vacuum generated in intake manifold 116 during a purge event. Conduit 151 may include a first check valve (CV1) 153 disposed therein. First check valve (CV1) 153 may prevent intake air from flowing through from intake manifold 116 into conduit 150, while allowing flow of fluid and fuel vapors from conduit 150 into intake manifold 116 via conduit 151 during a canister purging event. CV1 may be a vacuum actuated check valve, for example, that opens responsive to vacuum derived from intake manifold 116.

Conduit 148 may be coupled to ejector 140 at a first port or inlet 142. Ejector 140 includes a second port 144 or inlet coupling ejector 140 to conduit 150. Ejector 140 is coupled to intake 23 at a position upstream of throttle 114 and downstream of compressor 126 via a conduit 148. During boost conditions, conduit 148 may direct compressed air in intake conduit 118 downstream of compressor 126 into ejector 140 via port 142.

Ejector 140 may also be coupled to intake conduit 118 at a position upstream of compressor 126 via a shut-off valve 214. Shut-off valve 214 is hard-mounted directly to air induction system 173 along conduit 118 at a position between air filter 174 and compressor 126. For example, shut-off valve 214 may be coupled to an existing AIS nipple or other orifice, e.g., an existing SAE male quick connect port, in AIS 173. Hard-mounting may include a direct mounting that is inflexible. For example, an inflexible hard mount could be accomplished through a multitude of methods including spin welding, laser bonding, or adhesive. Shut-off valve 214 is coupled to a third port 146 or outlet of ejector 140. Shut-off valve 214 is configured to close in response to undesired emissions detected downstream of outlet 146 of ejector 140. As shown in FIG. 1, in some examples, a conduit or hose 152 may couple the third port 146 or outlet of ejector 140 to shut-off valve 214. In this example, if a disconnection of shut-off valve 214 with AIS 173 is detected, then shut-off valve 214 may close so air flow from the engine intake downstream of the compressor through the converging orifice in the ejector is discontinued. However, in other examples, shut-off valve may be integrated with ejector 140 and directly coupled thereto.

Ejector 140 includes a housing 168 coupled to ports 146, 144, and 142. In one example, only the three ports 146, 144, and 142 are included in ejector 140. Ejector 140 may include various check valves disposed therein. For example, in some examples, ejector 140 may include a check valve positioned adjacent to each port in ejector 140 so that unidirectional flow of fluid or air is present at each port. For example, air from intake conduit 118 downstream of compressor 126 may be directed into ejector 140 via inlet port 142 and may flow through the ejector and exit the ejector at outlet port 146 before being directed into intake conduit 118 at a position upstream of compressor 126. This flow of air through the ejector may create a vacuum due to the Venturi effect at inlet port 144 so that vacuum is provided to conduit 150 via port 144 during boosted operating conditions. In particular, a low pressure region is created adjacent to inlet port 144 which may be used to draw purge vapors from the canister into ejector 140.

Ejector 140 includes a nozzle 204 comprising an orifice which converges in a direction from inlet 142 toward suction inlet 144 so that when air flows through ejector 140 in a direction from port 142 towards port 146, a vacuum is created at port 144 due to the Venturi effect. This vacuum may be used to assist in fuel vapor purging during certain conditions, e.g., during boosted engine conditions. In one example, ejector 140 is a passive component. That is, ejector 140 is designed to provide vacuum to the fuel vapor purge system via conduit 150 to assist in purging under various conditions, without being actively controlled. Thus, whereas CPV 158 and throttle 114 may be controlled via controller 166, for example, ejector 140 may be neither controlled via controller 166 nor subject to any other active control. In another example, the ejector may be actively controlled with a variable geometry to adjust an amount of vacuum provided by the ejector to the fuel vapor recovery system via conduit 150.

During select engine and/or vehicle operating conditions, such as after an emission control device light-off temperature has been attained (e.g., a threshold temperature reached after warming up from ambient temperature) and with the engine running, the controller 166 may adjust the duty cycle of a canister vent valve solenoid (not shown) and open or maintain open canister vent valve 172. For example, canister vent valve 172 may remain open except during vacuum tests performed on the system (described in further detail below). At the same time, controller 12 may adjust the duty cycle of the CPV solenoid (not shown) and open CPV 158. Pressures within fuel vapor purging system 171 may then draw fresh air through vent 136, fuel vapor canister 104, and CPV 158 such that fuel vapors flow into conduit 150.

The operation of ejector 140 within fuel vapor purging system 171 during vacuum conditions will now be described. The vacuum conditions may include intake manifold vacuum conditions. For example, intake manifold vacuum conditions may be present during an engine idle condition, with manifold pressure below atmospheric pressure by a threshold amount. This vacuum in the intake system 23 may draw fuel vapor from the canister through conduits 150 and 151 into intake manifold 116, as represented by dashed line(s) 103 and 103*a*. Further, at least a portion of the fuel vapors may flow from conduit 150 into ejector 140 via port 144 via dashed line(s) 103, 103*b*, and 103*c*. Upon entering the ejector via port 144, the fuel vapors may flow through nozzle 204 toward port 142. Specifically, the intake manifold vacuum causes the fuel vapors to flow through orifice 212. Because the diameter of the area within the nozzle gradually increases in a direction from port 144 towards port 142, the fuel vapors flowing through the nozzle in this direction diffuse, which raises the pressure of the fuel vapors. After passing through the nozzle, the fuel vapors exit ejector 140 through first port 142 and flow through duct 148 to intake passage 118 and then to intake manifold 116, indicated by dashed line 103*c*.

Next, the operation of ejector 140 within fuel vapor purging system 171 during boost conditions will be described. The boost conditions may include conditions during which the compressor is in operation. For example, the boost conditions may include one or more of a high engine load condition and a super-atmospheric intake condition, with intake manifold pressure greater than atmospheric pressure by a threshold amount.

Fresh air enters intake passage 118 at air filter 174. During boost conditions, compressor 126 pressurizes the air in intake passage 118, such that intake manifold pressure is positive. Pressure in intake passage 118 upstream of compressor 126 is lower than intake manifold pressure during operation of compressor 126, and this pressure differential induces a flow of fluid from intake conduit 118 through duct 148 and into ejector 140 via ejector inlet 142. This fluid may include a mixture of air and fuel, in some examples. After the fluid flows into the ejector via the port 142, it flows through the converging orifice 212 in nozzle 204 in a direction from port 142 towards outlet 146. Because the diameter of the nozzle gradually decreases in a direction of this flow, a low pressure zone is created in a region of orifice 212 adjacent to suction inlet 144. The pressure in this low pressure zone may be lower than a pressure in duct 150. When present, this pressure differential provides a vacuum to conduit 150 to draw fuel vapor from canister 104, as indicated via dashed line(s) 105. This pressure differential may further induce flow of fuel vapors from the fuel vapor canister, through the CPV, and into port 144 of ejector 140. Upon entering the ejector, the fuel vapors may be drawn along with the fluid from the intake manifold out of the ejector via outlet port 146 and into intake 118 at a position upstream of compressor 126, as indicated via dashed lines 105*a* and 105*b*. Operation of compressor 126 then draws the fluid and fuel vapors from ejector 140 into intake passage 118 and through the compressor. After being compressed by compressor 126, the fluid and fuel vapors flow through charge air cooler 156, for delivery to intake manifold 116 via throttle 114.

Vehicle system 100 may further include a control system 160. Control system 160 is shown receiving information from a plurality of sensors 162 (various examples of which are described herein) and sending control signals to a plurality of actuators 164 (various examples of which are described herein). As one example, sensors 162 may include an exhaust gas sensor 125 (located in exhaust manifold 120) and various temperature and/or pressure sensors arranged in intake system 23. For example, a pressure or airflow sensor 115 in intake conduit 118 downstream of throttle 114, a pressure or air flow sensor 117 in intake conduit 118 between compressor 126 and throttle 114, and a pressure or air flow sensor 119 in intake conduit 118 upstream of compressor 126. In some examples, pressure sensor 119 may comprise a dedicated barometric pressure sensor. Other sensors such as additional pressure, temperature, air/fuel ratio, and composition sensors may be coupled to various locations in the vehicle system 100. As another example, actuators 164 may include fuel injectors 132, throttle 114, compressor 126, a fuel pump of pump system 130, etc. The control system 160 may include an electronic controller 166. The controller may receive input data from the various sensors, process the input data, and trigger the actuators in response to the processed input data based on instruction or code programmed therein corresponding to one or more routines.

Diagnostic tests may be periodically performed on the evaporative emissions control system 154 and fuel system 106 in order to indicate the presence or absence of undesired evaporative emissions. In one example, under natural aspiration conditions (e.g. intake manifold vacuum conditions), CVV 172 may be commanded closed, and CPV 158 may be commanded open. By commanding closed CVV 172 and commanding open CPV 158 during natural aspiration conditions, the evaporative emissions control system 154 and fuel system 106 may be evacuated (as indicated via dashed lines 103, and 103*a*) in order to ascertain the presence or absence of undesired evaporative emissions, by monitoring pressure in the fuel system and evaporative emissions control system. Pressure in the fuel system and evaporative emissions control system may be monitored, for example, via a pressure sensor 107. In some examples pressure sensor 107 may comprise a fuel tank pressure transducer (FTPT). If a threshold vacuum (e.g. negative pressure threshold with respect to atmospheric pressure) is reached during evacuating the evaporative emissions control system 154 and fuel system 106, an absence of gross undesired evaporative emissions may be indicated. Furthermore, if the threshold vacuum is reached, then it may be indicated that the first check valve (CV1) 153 is not stuck closed or substantially closed, as in a case where CV1 153 is stuck closed, pressure sensor 107 may not indicate pressure changes. However, in a case where CV1 is stuck closed, it may not be possible to indicate whether the threshold vacuum was not reached as a result of the CV1 being stuck closed, or due to gross undesired evaporative emissions in the evaporative emissions control system and/or fuel system. As will be discussed in further detail below, the inventors herein have developed systems and methods to address these issues.

In another example, under boost conditions (e.g. intake manifold pressure greater than barometric pressure by a predetermined threshold), again the CVV 172 may be commanded closed, and the CPV 158 may be commanded open. By commanding closed the CVV 172 and commanding open the CPV 158 during boost conditions, the evaporative emissions control system 154 and fuel system 106 may be evacuated (as indicated via dashed lines 105) in order to ascertain the presence or absence of undesired evaporative emissions. As discussed above, pressure in the fuel system and evaporative emissions control system may be monitored via, for example, pressure sensor 107. If a threshold vacuum (e.g., negative pressure threshold with respect to atmospheric pressure) is reached during evacuating the evaporative emissions control system 154 and fuel system 106, an absence of gross undesired evaporative emissions may be indicated. Furthermore, if the threshold vacuum is reached, then it may be indicated that the second check valve (CV2) 170 is not stuck closed or substantially closed, as in a case where CV2 170 is stuck closed, pressure sensor 107 may not indicate pressure changes. However, similar to that described above for the diagnostic test performed on the evaporative emissions control system 154 and fuel system 106 under natural aspiration conditions, a diagnostic test conducted during boost conditions where the threshold vacuum is not reached may not be able to discern whether inability to achieve the threshold vacuum is the result of a stuck closed CV2, or the presence of gross undesired evaporative emissions. As such, the inventors herein have developed systems and methods to address these issues.

Briefly, in order to conclusively ascertain whether failure to reach predetermined threshold(s) during evacuating the evaporative emissions control system 154 and fuel system 106 under either boost or natural aspiration conditions is the result of stuck closed CV1 or CV2 valves, or the result of gross undesired evaporative emissions, diagnostic tests under both boost conditions and under natural aspiration may be utilized in the same drive cycle. For example, and which will be discussed in greater detail below, a diagnostic test may first be conducted under boost conditions, and subsequently under natural aspiration conditions, or vice versa. By conducting diagnostic tests under both boost conditions and under natural aspiration conditions in the same drive cycle, functionality of both CV1 153 and CV2 170, along with the presence or absence undesired evaporative emissions may be conclusively indicated. Furthermore, responsive to an indication that either CV1 153 or CV2 170 is stuck closed, purge operations may be updated such that purge operations are only conducted via a flowpath that includes a check valve that is not stuck closed.

Figure 2:
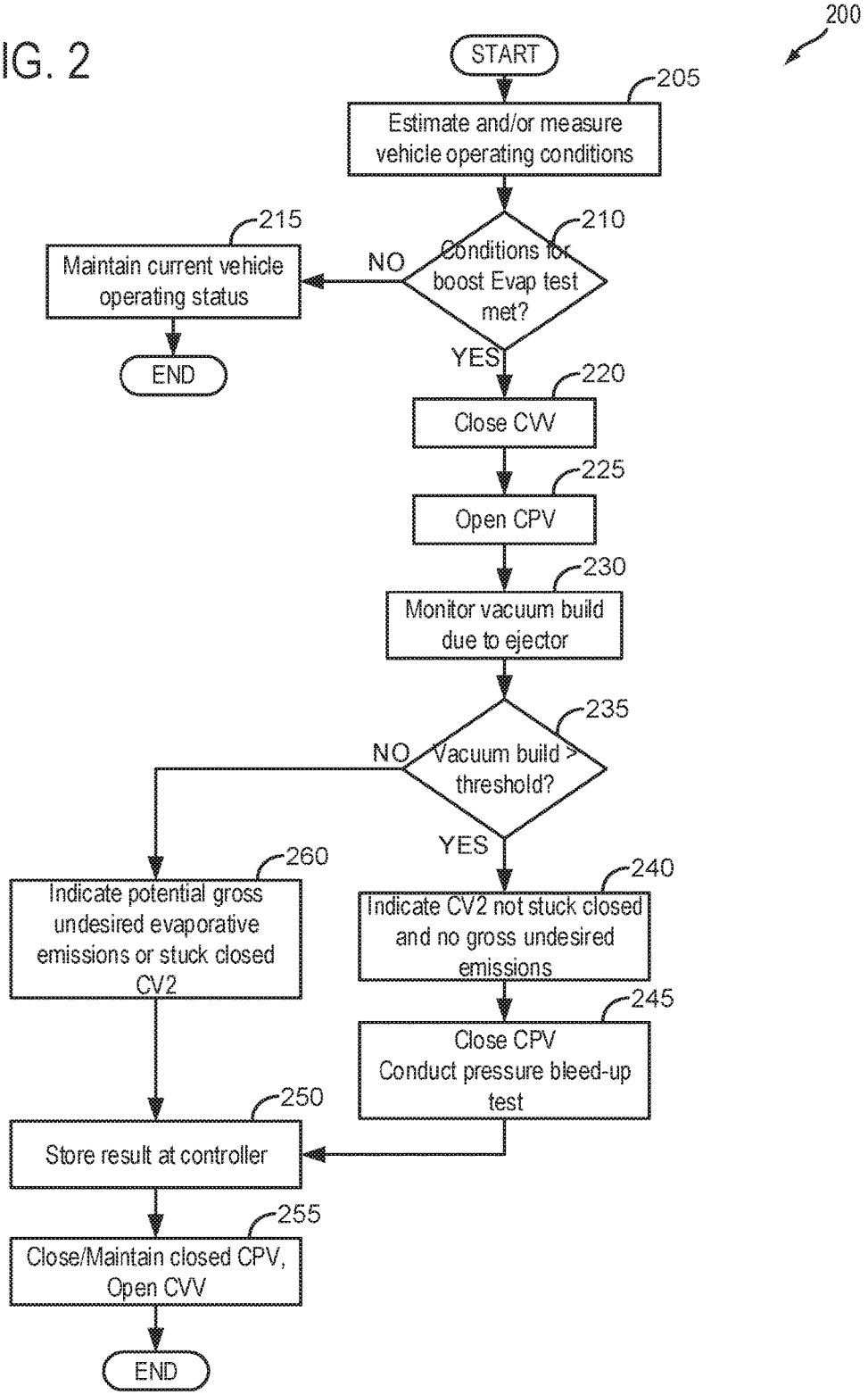
FIG. 2 shows a high-level flowchart for an example method for conducting an evaporative emissions test diagnostic procedure under boost conditions.

Turning to FIG. 2, a flow chart for a high level example method 200 for performing an evaporative emissions test diagnostic procedure on an evaporative emissions control system (e.g., 154) and fuel system (e.g., 106), is shown. More specifically, method 200 may be used to conduct an evaporative emissions test diagnostic procedure responsive to an indication that conditions are met for an evaporative emissions test under boost conditions. Conducting such an evaporative emissions test diagnostic procedure may include the fuel system and evaporative emission system being coupled to a compressor inlet through an orifice having an inlet pressure reduced by a venturing effect, thus enabling evacuation of the fuel system and evaporative emissions system under boost conditions. In this way, by conducting the evaporative emissions test under boost conditions, an absence of undesired evaporative emissions and an indication that a second check valve (CV2) (e.g., 170) is not stuck closed may be conclusively indicated responsive to a threshold vacuum being reached during conducting the evaporative emissions test diagnostic. Furthermore, responsive to an indication that the threshold vacuum is not reached during conducting the evaporative emissions test diagnostic, it may be indicated that either gross undesired emissions are present, or that CV2 is stuck closed. Whether the threshold vacuum is indicated to be reached or not, the results of the evaporative emissions test diagnostic procedure may be stored at the controller, as discussed in further detail below.

Method 200 will be described with reference to the systems described herein and shown in FIG. 1, though it should be understood that similar methods may be applied to other systems without departing from the scope of this disclosure. Method 200 may be carried out by a controller, such as controller 166 in FIG. 1, and may be stored at the controller as executable instructions in non-transitory memory. Instructions for carrying out method 200 and the rest of the methods included herein may be executed by the controller based on instructions stored on a memory of the controller and in conjunction with signals received from sensors of the engine system, such as the sensors described above with reference to FIG. 1. The controller may employ fuel system and evaporative emissions system actuators, such as canister purge valve (CPV) (e.g., 158), canister vent valve (CVV) (e.g., 172), etc., according to the method below.

Method 200 begins at 205 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing at 210, method 200 may include indicating whether conditions for an evaporative emissions test under boost are met. For example, conditions for an evaporative emissions test under boost being met may include an indication of manifold air pressure (MAP) greater than barometric pressure (BP) by a predetermined threshold amount. In some examples, conditions being met at 210 may include MAP greater than BP by a predetermined threshold for a predetermined time duration. Conditions being met at 210 may in some examples further include an indication that an evaporative emissions test diagnostic on the evaporative emissions control system and fuel system under boost conditions has not already been conducted during the current drive cycle. Conditions being met at 210 may in some examples further include an indication that a purge event is not in progress. Still further, conditions being met at 210 may in some examples include no prior indication of undesired evaporative emissions in the fuel system and/or evaporative emissions system, an no prior indication of CV2 (e.g., 170) being stuck closed.

If, at 210, conditions for an evaporative emissions test diagnostic procedure under boost are not indicated to be met, method 200 may proceed to 215. At 215, method 200 may include maintaining current vehicle operating status. For example, at 215, method 200 may include maintaining the CPV in its current configuration, maintaining the CVV in its current configuration. Furthermore, other engine system actuators such as throttle, fuel injectors, etc., may be maintained in their current status. Method 200 may then end.

Returning to 210, if it is indicated that conditions for an evaporative emissions test diagnostic procedure are met, method 200 may proceed to 220. At 220, method 200 may include commanding closed (actuating closed) the CVV. Proceeding to 225, method 200 may include commanding open (actuating open) the CPV. By commanding closed the CVV and commanding open the CPV, vacuum derived from the ejector (e.g., 140) under boost conditions may be applied to the evaporative emissions system (e.g., 154) and fuel system (e.g., 106). More specifically, by commanding closed the CVV at step 220, the evaporative emissions system and fuel system may be sealed from atmosphere. By commanding open the CPV at 225, vacuum derived from the ejector may be applied to the sealed evaporative emissions system and fuel system.

Proceeding to 230, method 200 may include monitoring vacuum build in the evaporative emissions system and fuel system. For example, monitoring vacuum build (e.g., negative pressure with respect to atmospheric pressure) may include monitoring pressure via a pressure sensor (e.g., 107), positioned in the fuel system and/or evaporative emissions system. Monitoring vacuum build at 230 may be conducted for a predetermined time duration, in some examples.

Accordingly, proceeding to 235, method 200 may include indicating whether vacuum build as monitored by the pressure sensor during evacuating the evaporative emissions system and fuel system is greater than a predetermined threshold. The predetermined threshold may be in some examples be a function of atmospheric pressure. For example, the predetermined threshold may comprise a decreased vacuum level responsive to decreasing barometric pressure, and increased vacuum level responsive to increasing barometric pressure. The predetermined threshold may be further based on a predetermined diameter, or area, of an orifice whereby undesired evaporative emissions may be escaping from in the fuel system and/or evaporative emissions system.

At 235, if it is indicated that vacuum build in the fuel system and evaporative emissions system has reached the predetermined threshold, method 200 may proceed to 240. At 240, method 200 may further include indicating that CV2 (e.g., 170) is not stuck closed. If CV2 were stuck closed, then the pressure sensor (e.g., 107) would not have registered a change in pressure during evacuating the fuel system and evaporative emissions system. In other words, the CV2 must be functioning as desired responsive to the predetermined threshold vacuum being reached. Furthermore, at 240, it may be indicated that there are no gross undesired evaporative emissions stemming from the fuel system and/or evaporative emissions system. For example, method 200 may include indicating an absence of gross undesired evaporative emissions stemming from an orifice the size of the predetermined diameter, or area, discussed above at 235, where the predetermined diameter, or area, corresponds to gross undesired evaporative emissions. In some examples, gross undesired evaporative emissions may include an orifice diameter corresponding to 0.04" or greater.

Proceeding to 245, method 200 may include closing the CPV to isolate the fuel system and evaporative emissions system from atmosphere and from engine intake, and monitoring a pressure bleed-up in the fuel system and evaporative emissions system. Again, pressure may be monitored by a pressure sensor (e.g., 107). Pressure may be monitored for a predetermined duration, in some examples. If pressure in the fuel system and evaporative emissions system reaches a predetermined threshold pressure, or if a rate of pressure bleed-up exceeds a predetermined pressure bleed-up rate, then non-gross undesired evaporative emissions may be indicated. However, if, during the predetermined duration, pressure does not reach the predetermined threshold pressure, or if the rate of pressure bleed-up does not exceed the predetermined pressure bleed-up rate, then it may be indicated that non-gross undesired evaporative emissions are not present. While step 240 includes indicating an absence of gross undesired evaporative emissions, it may be understood that at step 245, indicating the presence or absence of non-gross undesired evaporative emissions comprises undesired evaporative emissions stemming from a smaller orifice size than that corresponding to gross undesired evaporative emissions. For example, at 245, non-gross undesired evaporative emissions may be indicated corresponding to an orifice size substantially smaller than an orifice size corresponding to gross undesired evaporative emissions. As such, step 245 comprises testing for presence or absence of non-gross undesired evaporative emissions by comparing a pressure change in the fuel system or evaporative emission system to a reference pressure change after evacuating the fuel system and evaporative emissions system.

Proceeding to step 250, method 200 may include storing the results of the evaporative emissions test diagnostic procedure at the controller. As will be discussed in further detail below with regard to FIGS. 4-5, and FIG. 7, the results of the evaporative emissions test diagnostic procedure conducted according to method 200 may in some examples be utilized in conjunction with results of an evaporative emissions test diagnostic procedure conducted under natural aspiration (see FIG. 3), in order to conclusively determine the presence or absence of undesired evaporative emissions, and functionality of both CV2 (e.g., 170) and a first check valve (CV1) (e.g., 153).

Continuing to 255, method 200 may include maintaining closed the CPV, and commanding open the CVV. By maintaining closed the CPV, the fuel system and evaporative emissions system may be sealed from engine intake (and from the ejector). Furthermore, by commanding open the CVV, fuel vapors generated in the fuel tank (for example running loss fuel vapors, refueling vapors, or vapors resulting from diurnal temperature fluctuations) may be routed to the fuel vapor canister (e.g., 104) for storage, prior to exiting to atmosphere. Method 200 may then end.

Returning to 235, if it is indicated that vacuum build in the fuel system and evaporative emissions system did not reach the predetermined threshold vacuum, method 200 may proceed to 260. At 260, method 200 may include indicating that either CV2 is stuck closed, or that gross undesired evaporative emissions are present in the fuel system and evaporative emissions system. In other words, the vacuum build may have been prevented from reaching the predetermined vacuum threshold due to the CV2 being stuck closed, or due to gross undesired evaporative emissions. Accordingly, a conclusive determination as to the source of the failure to reach the predetermined threshold vacuum may not be indicated at 260. Instead, method 200 may proceed to 250. At 250, method 200 may include storing the results of the evaporative emissions test diagnostic at the controller. As discussed above, and which will be discussed in further detail below with regard to FIGS. 4-5, and FIG. 7, the results of the evaporative emissions test diagnostic procedure conducted according to method 200 may in some examples be utilized in conjunction with results of an evaporative emissions test diagnostic procedure conducted under natural aspiration (see FIG. 3), in order to conclusively determine why the threshold vacuum was not reached during evacuating the evaporative emissions system and fuel system according to method 200.

Continuing to 255, method 200 may include commanding closed the CPV, and commanding open the CVV. As described above, by commanding closed the CPV, the fuel system and evaporative emissions system may be sealed from engine intake (and from the ejector). Furthermore, by commanding open the CVV, fuel vapors generated in the fuel tank (for example running loss fuel vapors, refueling vapors, or vapors resulting from diurnal temperature fluctuations) may be routed to the fuel vapor canister (e.g., 104) for storage, prior to exiting to atmosphere. Method 200 may then end.

Figure 3:
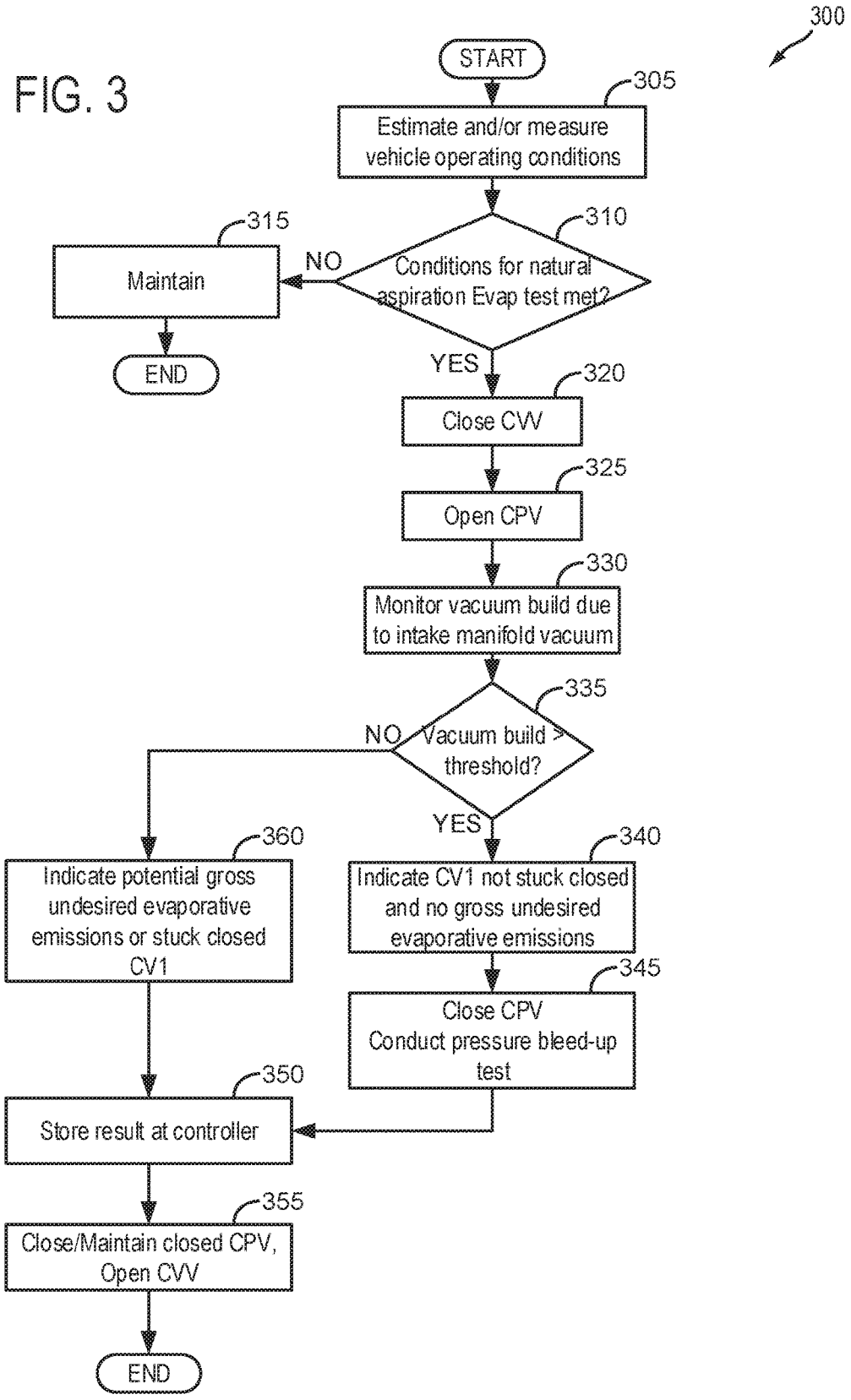
FIG. 3 shows a high-level flowchart for an example method for conducting an evaporative emissions test diagnostic procedure under natural aspiration (intake manifold vacuum) conditions.
Figure 4:
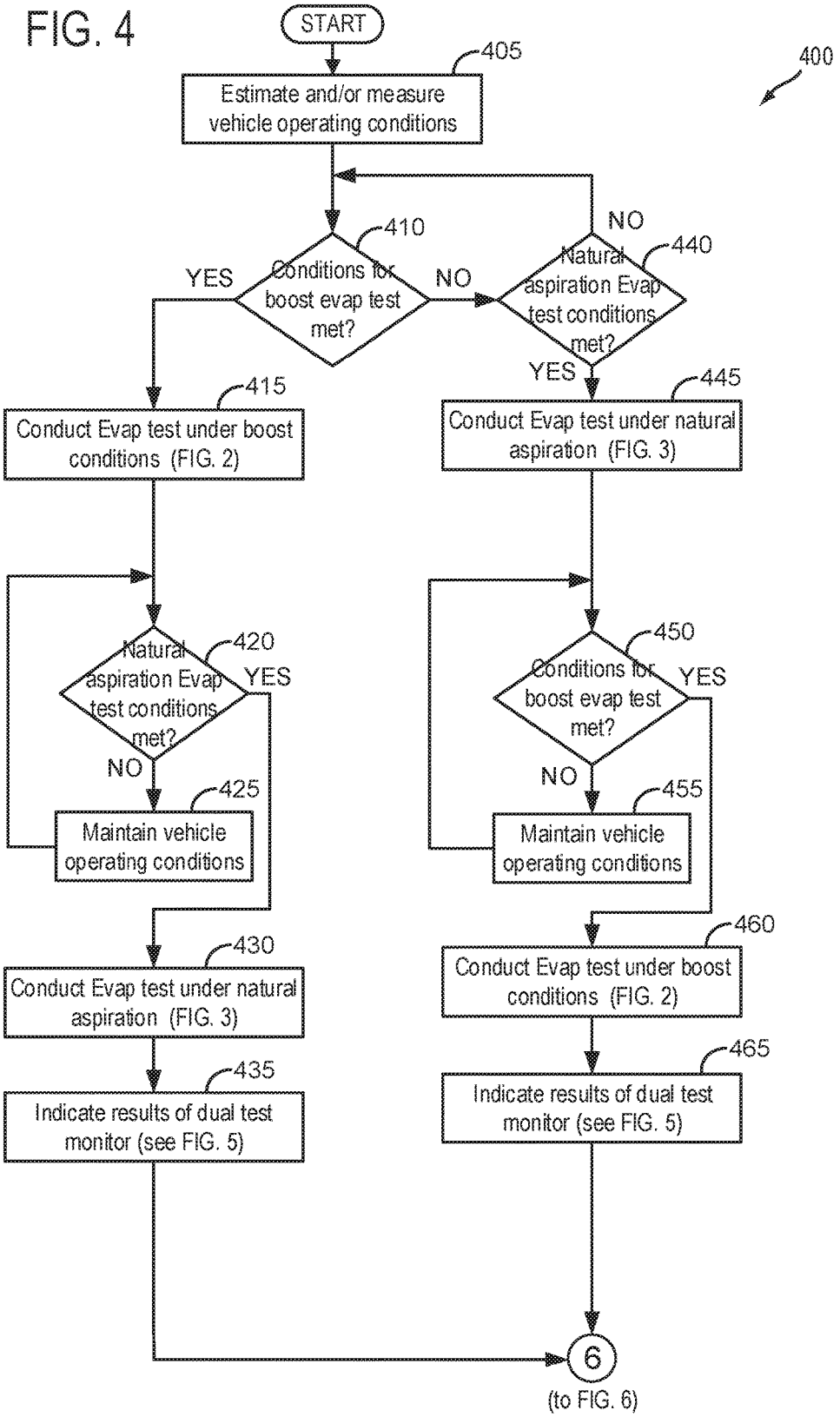
FIG. 4 shows a high-level flowchart for an example method for conducting an evaporative emissions test diagnostic procedure under both boost conditions and natural aspiration conditions in the same drive cycle.

Turning now to FIG. 3, a flow chart for a high level example method 300 for performing an evaporative emissions test diagnostic procedure on an evaporative emissions control system (e.g., 154) and fuel system (e.g., 106), is shown. More specifically, method 300 may be used to conduct an evaporative emissions test diagnostic procedure responsive to an indication that conditions are met for an evaporative emissions test under natural aspiration (intake manifold vacuum) conditions. In this way, by conducting the evaporative emissions test under natural aspiration conditions, an absence of undesired evaporative emissions and an indication that a first check valve (CV1) (e.g., 153) is not stuck closed may be conclusively indicated responsive to a threshold vacuum being reached during conducting the evaporative emissions test diagnostic. Furthermore, responsive to an indication that the threshold vacuum is not reached during conducting the evaporative emissions test diagnostic, it may be indicated that either gross undesired emissions are present, or that CV1 is stuck closed. Whether the threshold vacuum is indicated to be reached or not, the results of the evaporative emissions test diagnostic procedure may be stored at the controller, as discussed in further detail below.

Method 300 will be described with reference to the systems described herein and shown in FIG. 1, though it should be understood that similar methods may be applied to other systems without departing from the scope of this disclosure. Method 300 may be carried out by a controller, such as controller 166 in FIG. 1, and may be stored at the controller as executable instructions in non-transitory memory. Instructions for carrying out method 300 and the rest of the methods included herein may be executed by the controller based on instructions stored on a memory of the controller and in conjunction with signals received from sensors of the engine system, such as the sensors described above with reference to FIG. 1. The controller may employ fuel system and evaporative emissions system actuators, such as canister purge valve (CPV) (e.g., 158), canister vent valve (CVV) (e.g., 172), etc., according to the method below.

Method 300 begins at 305 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 310, method 300 may include indicating whether conditions for an evaporative emissions test under natural aspiration (intake manifold vacuum) are met. For example, conditions for an evaporative emissions test under natural aspiration may include an indication of manifold air pressure (MAP) less than barometric pressure (BP) by a predetermined threshold amount. In some examples, conditions being met at 310 may include MAP being less than BP by the predetermined threshold amount for a predetermined time duration. Conditions being met at 310 may in some examples further include an indication that an evaporative emission test diagnostic on the evaporative emissions control system and fuel system under natural aspiration conditions has not already been conducted during the current drive cycle. Conditions being met at 310 may in some examples further include an indication that a purge event is not in progress. Still further, conditions being met at 310 may in some examples include no prior indication of undesired evaporative emissions in the fuel system and/or evaporative emissions system, and no prior indication of CV1 (e.g., 153) being stuck closed.

If, at 310, conditions for an evaporative emissions test diagnostic procedure under natural aspiration are not indicated to be met, method 300 may proceed to 315. At 315, method 300 may include maintaining current vehicle operating status. For example, at 315, method 300 may include maintaining the CPV in its current configuration, maintaining the CVV in its current configuration. Furthermore, other engine system actuators such as throttle, fuel injectors, etc., may be maintained in their current status. Method 300 may then end.

Returning to 310, if it is indicated that conditions for an evaporative emissions test diagnostic procedure are met, method 300 may proceed to 320. At 320, method 300 may include commanding closed (actuating closed) the CVV. Proceeding to 325, method 200 may include commanding open (actuating open) the CPV. By commanding closed the CVV and commanding open the CPV, vacuum derived from the intake manifold under natural aspiration conditions may be applied to the evaporative emissions system (e.g., 154) and fuel system (e.g., 106). More specifically, by commanding closed the CVV at step 220, the evaporative emissions system and fuel system may be sealed from atmosphere. By commanding open the CPV at 225, vacuum derived from the intake manifold may be applied to the sealed evaporative emissions system and fuel system.

Proceeding to 330, method 300 may include monitoring vacuum build in the evaporative emissions system and fuel system. For example, as discussed above, monitoring vacuum build (e.g., negative pressure with respect to atmospheric pressure) may include monitoring pressure via a pressure sensor (e.g., 107), positioned in the fuel system and/or evaporative emissions system. Monitoring vacuum build at 330 may be conducted for a predetermined time duration, in some examples.

Accordingly, proceeding to 335, method 300 may include indicating whether vacuum build as monitored by the pressure sensor during evacuating the evaporative emissions system and fuel system is greater than a predetermined threshold. As discussed above with regard to FIG. 2, the predetermined threshold may be in some examples be a function of atmospheric pressure. For example, the predetermined threshold may comprise a decreased vacuum level responsive to decreasing barometric pressure, and increased vacuum level responsive to increasing barometric pressure. The predetermined threshold may be further based on a predetermined diameter, or area, of an orifice whereby undesired evaporative emissions may be escaping from in the fuel system and/or evaporative emissions system.

At 335, if it is indicated that vacuum build in the fuel system and evaporative emissions system has reached the predetermined threshold, method 300 may proceed to 340. At 340, method 300 may include indicating that CV1 (e.g., 153) is not stuck closed or substantially closed. If CV1 were stuck closed, then the pressure sensor (e.g., 107) would not have registered a change in pressure during evacuating the fuel system and evaporative emissions system. In other words, the CV1 must be functioning as desired responsive to the predetermined threshold vacuum being reached. Furthermore, at 340, it may be indicated that there are no gross undesired evaporative emissions stemming from the fuel system and/or evaporative emissions system. For example, method 300 may include indicating an absence of gross undesired evaporative emissions stemming from an orifice the size of the predetermined diameter, or area, discussed above at 335, where the predetermined diameter, or area, corresponds to gross undesired evaporative emissions. In some examples, gross undesired evaporative emissions may include an orifice diameter corresponding to 0.04" or greater.

Proceeding to 345, method 300 may include closing the CPV to isolate the fuel system and evaporative emissions system from atmosphere and from engine intake, and monitoring a pressure bleed-up in the fuel system and evaporative emissions system. Again, pressure may be monitored by a pressure sensor (e.g., 107). Pressure may be monitored for a predetermined duration, in some examples. If pressure in the fuel system and evaporative emissions system reaches a predetermined threshold pressure, or if a rate of pressure bleed-up exceeds a predetermined pressure bleed-up rate, then non-gross undesired evaporative emissions may be indicated. However, if, during the predetermined duration, pressure does not reach the predetermined threshold pressure, or if the rate of pressure bleed-up does not exceed the predetermined pressure bleed-up rate, then it may be indicated that non-gross undesired evaporative emissions are not present. While step 340 includes indicating an absence of gross undesired evaporative emissions, it may be understood that at step 345, indicating the presence or absence of non-gross undesired evaporative emissions comprises undesired evaporative emissions stemming from a smaller orifice size than that corresponding to gross undesired evaporative emissions. For example, at 345, non-gross undesired evaporative emissions may be indicated corresponding to an orifice size substantially smaller than an orifice size corresponding to gross undesired evaporative emissions. As such, step 345 comprises testing for presence or absence of non-gross undesired evaporative emissions by comparing a pressure change in the fuel system or evaporative emission system to a reference pressure change after evacuating the fuel system and evaporative emissions system.

Proceeding to step 350, method 300 may include storing the results of the evaporative emissions test diagnostic procedure at the controller. As will be discussed in further detail below with regard to FIGS. 4-5, and FIG. 7, the results of the evaporative emissions test diagnostic procedure conducted according to method 300 may in some examples be utilized in conjunction with results of an evaporative emissions test diagnostic procedure conducted under boost conditions (see FIG. 2), in order to conclusively determine the presence or absence of undesired evaporative emissions, and functionality of both CV2 (e.g., 170) and a first check valve (CV1) (e.g., 153).

Continuing to 355, method 300 may include maintaining closed the CPV, and commanding open the CVV. By maintaining closed the CPV, the fuel system and evaporative emissions system may be sealed from engine intake (and from the ejector). Furthermore, by commanding open the CVV, fuel vapors generated in the fuel tank (for example running loss fuel vapors, refueling vapors, or vapors resulting from diurnal temperature fluctuations) may be routed to the fuel vapor canister (e.g., 104) for storage, prior to exiting to atmosphere. Method 300 may then end.

Returning to 335, if it is indicated that vacuum build in the fuel system and evaporative emissions system did not reach the predetermined threshold vacuum, method 300 may proceed to 360. At 360, method 300 may include indicating that either CV1 is stuck closed, or that gross undesired evaporative emissions are present in the fuel system and evaporative emissions system. In other words, the vacuum build may have been prevented from reaching the predetermined vacuum threshold due to the CV1 being stuck closed, or due to gross undesired evaporative emissions. Accordingly, a conclusive determination as to the source of the failure to reach the predetermined threshold vacuum may not be indicated at 360. Instead, method 300 may proceed to 350. At 350, method 300 may include storing the results of the evaporative emissions test diagnostic at the controller. As discussed above, and which will be discussed in further detail below with regard to FIGS. 4-5, and FIG. 7, the results of the evaporative emissions test diagnostic procedure conducted according to method 200 may in some examples be utilized in conjunction with results of an evaporative emissions test diagnostic procedure conducted under boost conditions (see FIG. 2), in order to conclusively determine why the threshold vacuum was not reached during evacuating the evaporative emissions system and fuel system according to method 300.

Continuing to 355, method 300 may include commanding closed the CPV, and commanding open the CVV. As described above, by commanding closed the CPV, the fuel system and evaporative emissions system may be sealed from engine intake (and from the ejector). Furthermore, by commanding open the CVV, fuel vapors generated in the fuel tank (for example running loss fuel vapors, refueling vapors, or vapors resulting from diurnal temperature fluctuations) may be routed to the fuel vapor canister (e.g., 104) for storage, prior to exiting to atmosphere. Method 200 may then end.

Turning now to FIG. 4, a flow chart for a high level example method 400 for conducting an evaporative emissions test diagnostic procedure under both boost conditions and natural aspiration conditions in the same drive cycle, is shown. In other words, method 400 comprises a dual test monitor. More specifically, method 400 includes supplying fuel from a fuel system to an engine during a single drive cycle which comprises a duration between a key-on event and a key-off event, and storing fuel vapors from the fuel system in an evaporative emissions system removably coupled to the fuel system. During the single drive cycle, method 400 includes evacuating the fuel system and evaporative emissions system through a first check valve (CV1) (e.g., 153) in a first condition, and evacuating the fuel system and evaporative emissions system through a second check valve (CV2) (e.g., 170) in a second condition. Accordingly, the presence or absence of gross undesired evaporative emissions in the fuel system and/or evaporative emissions system, and whether one of the first check valve or the second check valve is stuck substantially closed, may be indicated based on a vacuum level reached during the evacuating of the fuel system and evaporative emissions system in both the first condition and the second condition.

Method 400 will be described with reference to the systems described herein and shown in FIG. 1, though it should be understood that similar methods may be applied to other systems without departing from the scope of this disclosure. Method 400 will be further described with reference to the methods described herein and shown in FIGS. 2-3. Method 400 may be carried out by a controller, such as controller 166 in FIG. 1, and may be stored at the controller as executable instructions in non-transitory memory. Instructions for carrying out method 400 and the rest of the methods included herein may be executed by the controller based on instructions stored on a memory of the controller and in conjunction with signals received from sensors of the engine system, such as the sensors described above with reference to FIG. 1. The controller may employ fuel system and evaporative emissions system actuators, such as canister purge valve (CPV) (e.g., 158), canister vent valve (CVV) (e.g., 172), etc., according to the method below. In some examples, method 400 may be enabled responsive to a key-on event.

Method 400 begins at 405 and may include estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 410, method 400 may include indicating whether conditions for an evaporative emissions test diagnostic under boost conditions are met. Briefly, as discussed above with regard to FIG. 2, conditions for an evaporative emissions test diagnostic under boost being met may include an indication of manifold air pressure (MAP) greater than barometric pressure (BP) by a predetermined threshold amount, for a predetermined time duration, for example. Conditions being met may further include an indication that an evaporative emissions test diagnostic under boost has not already been conducted during the current drive cycle, an indication that a purge event is not in progress, an absence of a previous indication of undesired evaporative emissions in the fuel system and/or evaporative emissions system, and no prior indication of a CV1 (e.g., 153) or CV2 (e.g., 170) being stuck closed.

If, at 410, it is indicated that conditions for an evaporative emissions test diagnostic procedure under boost conditions are met, method 400 may proceed to 415. At 415, method 400 may include conducting the evaporative emissions test under boost conditions, according to the method described in detail above with regard to FIG. 2. As discussed above with regard to FIG. 2, subsequent to conducting the evaporative emissions test diagnostic procedure under boost conditions, the results of the test diagnostic may be stored at the controller, in order to utilize the results in conjunction with results of an evaporative emissions test diagnostic procedure conducted under natural aspiration during the same drive cycle, discussed in further detail below.

Accordingly, subsequent to conducting the evaporative emissions test diagnostic procedure under boost conditions and storing the results at the controller according to method 200 depicted in FIG. 2, method 400 may proceed to 420. At 420, method 400 may include indicating whether conditions for an evaporative emissions test diagnostic procedure under natural aspiration conditions are met. As discussed above with regard to method 300 depicted in FIG. 3, conditions for conducting the evaporative emissions test diagnostic under natural aspiration may include an indication of manifold air pressure (MAP) less than barometric pressure (BP) by a predetermined threshold amount, for a predetermined time duration, for example. Conditions being met at 420 may further include an indication(s) that an evaporative emissions test diagnostic procedure under natural aspiration conditions has not previously been conducted during the current drive cycle, that a purge event is not in progress, that undesired evaporative emissions have not previously been indicated in the fuel system and/or evaporative emissions system, and that the CV1 (e.g., 153) has not previously been indicated to be stuck closed.

If, at 420, it is indicated that conditions for an evaporative emissions test diagnostic procedure under natural aspiration conditions are not met, method 400 may proceed to 425. At 425, method 400 may include maintaining vehicle operating conditions, until it is indicated that conditions are met for conducting an evaporative emissions test diagnostic under natural aspiration conditions. For example, a status of evaporative emissions system actuators (e.g., CPV, CVV), fuel system actuators (e.g., fuel injectors, etc.), engine operational status (air fuel ratio, spark timing, etc.), may be maintained.

If, at 420, it is indicated that conditions for an evaporative emissions test diagnostic procedure under natural aspiration conditions are met, method 400 may proceed to 430. At 430, method 400 may include conducting the evaporative emissions test diagnostic procedure under natural aspiration, according to the method depicted above with regard to FIG. 3. As discussed above with regard to FIG. 3, subsequent to conducting the evaporative emissions test diagnostic procedure under natural aspiration conditions, the results of the test diagnostic may be stored at the controller, in order to utilize the results in conjunction with results of the evaporative emissions test diagnostic procedure conducted under boost during the same drive cycle.

Accordingly, proceeding to 435, method 400 may include indicating the results of the dual test monitor. Specifically, results from the evaporative emissions test diagnostic procedure under both boost conditions and natural aspiration conditions may be analyzed and interpreted by the controller, for example, in order to indicate whether CV1 (e.g., 153) is stuck closed or not, whether CV2 (e.g., 170) is stuck closed or not, and whether undesired evaporative emissions are present in the evaporative emissions system (e.g., 154) and/or fuel system (e.g., 106). In some examples, the results of the dual test monitor may be interpreted/analyzed with regard to a lookup table stored at the controller.

Turning to FIG. 5, an example lookup table 500 for interpreting (analyzing) results from the dual test monitor, is shown. Four potential outcomes from the dual test monitor are indicated by letters A, B, C, and D. The four potential out comes will accordingly be described herein.

Outcome A may comprise an example wherein the predetermined vacuum threshold was reached under both boost conditions, and under natural aspiration conditions. In such an example outcome A, it may be indicated that both CV1 and CV2 are not stuck closed, and that no gross undesired evaporative emissions (e.g., 0.04" or greater orifice diameter size) are present in the fuel system and evaporative emissions system. If one of the valves were stuck closed, then the predetermined vacuum would not have been reached under conditions wherein the fuel system and evaporative emissions were attempted to be evacuated via the route comprising the stuck closed valve.

Outcome B may comprise an example wherein the predetermined vacuum threshold was not reached under boost conditions, and additionally the predetermined vacuum threshold was not reached under natural aspiration conditions. In such an example outcome B, it may be indicated with high probability that both CV1 and CV2 are not stuck closed, but that the reason for the predetermined vacuum threshold not being reached under both boost conditions and natural aspiration conditions is because of the presence of gross undesired evaporative emissions in the fuel system and/or evaporative emissions system. For example, it may be a low probability event that both CV1 and CV2 are stuck closed. Thus, if the tests under boost conditions and natural aspiration conditions both indicate a failure to reach the predetermined vacuum threshold, the most likely explanation is that gross undesired evaporative emissions are present in the fuel system and/or evaporative emissions system. As such, a technician may be directed to first look for the presence of undesired evaporative emissions, responsive to an indication of outcome B subsequent to conducting the dual test monitor. In such an example scenario, if gross undesired evaporative emissions are not found by a technician, then the culprit of the outcome B may be that both CV1 and CV2 are stuck closed.

Outcome C may comprise an example wherein the predetermined vacuum threshold was reached under boost conditions, but wherein the predetermined vacuum threshold was not reached under natural aspiration conditions. In other words, a predetermined negative pressure was not reached when evacuating the fuel system and evaporative emissions system during a natural aspirated mode of engine operation, but was reached when reducing pressure during a boosted mode of engine operation. In such an example outcome C, it may be indicated that CV2 is not stuck closed, that CV1 is substantially stuck closed, and that gross undesired evaporative emissions are not present in the fuel system and evaporative emissions system. More specifically, because the predetermined vacuum threshold was reached under one condition, gross undesired evaporative emissions cannot be present, otherwise the predetermined vacuum threshold could not have been reached. Furthermore, because the predetermined vacuum threshold was not reached under one condition (under natural aspiration in this example), then it may be conclusively determined that CV1 is stuck closed. As such, a technician may be directed to mitigating the stuck closed CV1, rather than searching for a source of gross undesired evaporative emissions in the fuel system and evaporative emissions system, for example.

Outcome D may comprise an example wherein the predetermined vacuum threshold was not reached under boost conditions, but wherein the predetermined vacuum threshold was reached under natural aspiration conditions. In other words, a predetermined negative pressure was not reached when evacuating the fuel system and evaporative emissions system during a boosted mode of engine operation, but was reached when reducing pressure during a natural aspirated mode of engine operation. In such an example outcome D, it may be indicated that CV2 is substantially stuck closed, that CV1 is not stuck closed, and that no gross undesired evaporative emissions are present in the fuel system and evaporative emissions system. For example, similar to outcome C, because the predetermined vacuum threshold was reached under one condition, gross undesired evaporative emissions cannot be present, otherwise the predetermined vacuum threshold could not have been reached. Furthermore, because the predetermined vacuum threshold was not reached under one condition (boost condition in this example), then it may be conclusively determined that CV2 is stuck substantially closed. As such, a technician may be directed to mitigating the stuck closed CV2, rather than searching for a source of undesired evaporative emissions in the fuel system and evaporative emissions system, for example.

In summary, example lookup table 500 may be utilized in order to interpret the results of the dual test monitor conducted according to method 400 depicted at FIG. 4. Accordingly, returning to step 435 of FIG. 4, responsive to indicating the results of the dual test monitor via, for example, lookup table 500, method 400 may proceed to method 600 depicted at FIG. 6 wherein canister purge operations may be adjusted according to the outcome of the dual test monitor. Furthermore, responsive to an indication that either CV1 or CV2 are stuck closed, or responsive to an indication of undesired evaporative emissions, a malfunction indicator light (MIL) may be illuminated on a dash of the vehicle, for example, alerting a vehicle operator to service the vehicle, and may further include indicating the reason for the MIL.

Returning to 410, if it is indicated that conditions are not met for an evaporative emissions test diagnostic procedure under boost conditions, method 400 may proceed to 440. At 440, method 400 may include indicating whether conditions are met for conducting an evaporative emissions test diagnostic procedure under natural aspiration conditions. As discussed above with regard to step 310 of method 300 and step 420 of method 400, conditions for conducting the evaporative emissions test diagnostic under natural aspiration may include an indication of manifold air pressure (MAP) less than barometric pressure (BP) by a predetermined threshold amount, for a predetermined time duration, for example. Conditions being met at 440 may further include an indication(s) that an evaporative emissions test diagnostic procedure under natural aspiration conditions has not previously been conducted during the current drive cycle, that a purge event is not in progress, that undesired evaporative emissions have not previously been indicated in the fuel system and/or evaporative emissions system, and that the CV1 (e.g., 153) has not previously been indicated to be stuck closed.

If, at 440, it is indicated that conditions for an evaporative emissions test diagnostic procedure under natural aspiration conditions are met, method 400 may proceed to 445. At 445, method 400 may include conducting the evaporative emissions test under natural aspiration, according to the method described in detail above with regard to FIG. 3. As discussed above with regard to FIG. 3, subsequent to conducting the evaporative emissions test under natural aspiration conditions, the results of the test diagnostic may be stored at the controller, in order to utilize the results in conjunction with results of an evaporative emissions test diagnostic procedure conducted under boost conditions during the same drive cycle.

Accordingly, subsequent to conducting the evaporative emissions test diagnostic procedure under natural aspiration conditions and storing the results at the controller according to method 300 depicted in FIG. 3, method 400 may proceed to 450. At 450, method 400 may include indicating whether conditions for an evaporative emissions test diagnostic procedure under boost conditions are met. As discussed above with regard to step 210 of method 200 and parts of step 410 of method 400, conditions for conducting the evaporative emissions test diagnostic under boost conditions at 450 may include an indication of manifold air pressure (MAP) greater than barometric pressure (BP) by a predetermined threshold amount, for a predetermined time duration, for example. Conditions being met may further include an indication that an evaporative emissions test diagnostic under boost has not already been conducted during the current drive cycle, an indication that a purge event is not in progress, an absence of a previous indication of undesired evaporative emissions in the fuel system and/or evaporative emissions system, and no prior indication of CV2 (e.g., 170) being stuck closed.

If, at 450, it is indicated that conditions for an evaporative emissions test diagnostic procedure under boost conditions are not met, method 400 may proceed to 455. At 455, method 400 may include maintaining vehicle operating conditions, until it is indicated that conditions are met for conducting an evaporative emissions test diagnostic under boost conditions. For example, a status of evaporative emissions system actuators (e.g., CPV, CVV), fuel system actuators (e.g., fuel injectors, etc.), engine operational status (air fuel ratio, spark timing, etc.), may be maintained.

If, at 450, it is indicated that conditions for an evaporative emissions test diagnostic procedure under boost conditions are met, method 400 may proceed to 460. At 460, method 400 may include conducting the evaporative emissions test procedure under boost conditions, according to the method depicted above with regard to FIG. 2. As discussed above with regard to FIG. 2, subsequent to conducting the evaporative emissions test diagnostic procedure under boost conditions, the results of the test diagnostic may be stored at the controller, in order to utilize the results in conjunction with results of the evaporative emissions test diagnostic procedure conducted under natural aspiration conditions during the same drive cycle.

Accordingly, proceeding to 465, method 400 may include indicating the results of the dual test monitor. As discussed above with regard to step 435 of method 400, results from the evaporative emissions test diagnostic procedure under both natural aspiration conditions and boost conditions may be analyzed and interpreted by the controller, according to a lookup table such as lookup table 500 depicted at FIG. 5. To avoid redundancy, a thorough description of FIG. 5 will not be reiterated here, but it may be understood that at step 465, results of the dual test monitor may be interpreted according to lookup table depicted at FIG. 5, as discussed in detail above. Furthermore, as discussed above, responsive to an indication that either CV1 or CV2 are stuck closed, or responsive to an indication of undesired evaporative emissions, a malfunction indicator light (MIL) may be illuminated on a dash of the vehicle, for example, alerting a vehicle operator to service the vehicle, and may further include indicating the reason for the MIL. Responsive to indicating the results of the dual test monitor at 465, method 400 may proceed to method 600 depicted at FIG. 6 wherein canister purge operations may be adjusted according to the outcome of the dual test monitor.

Figure 6:
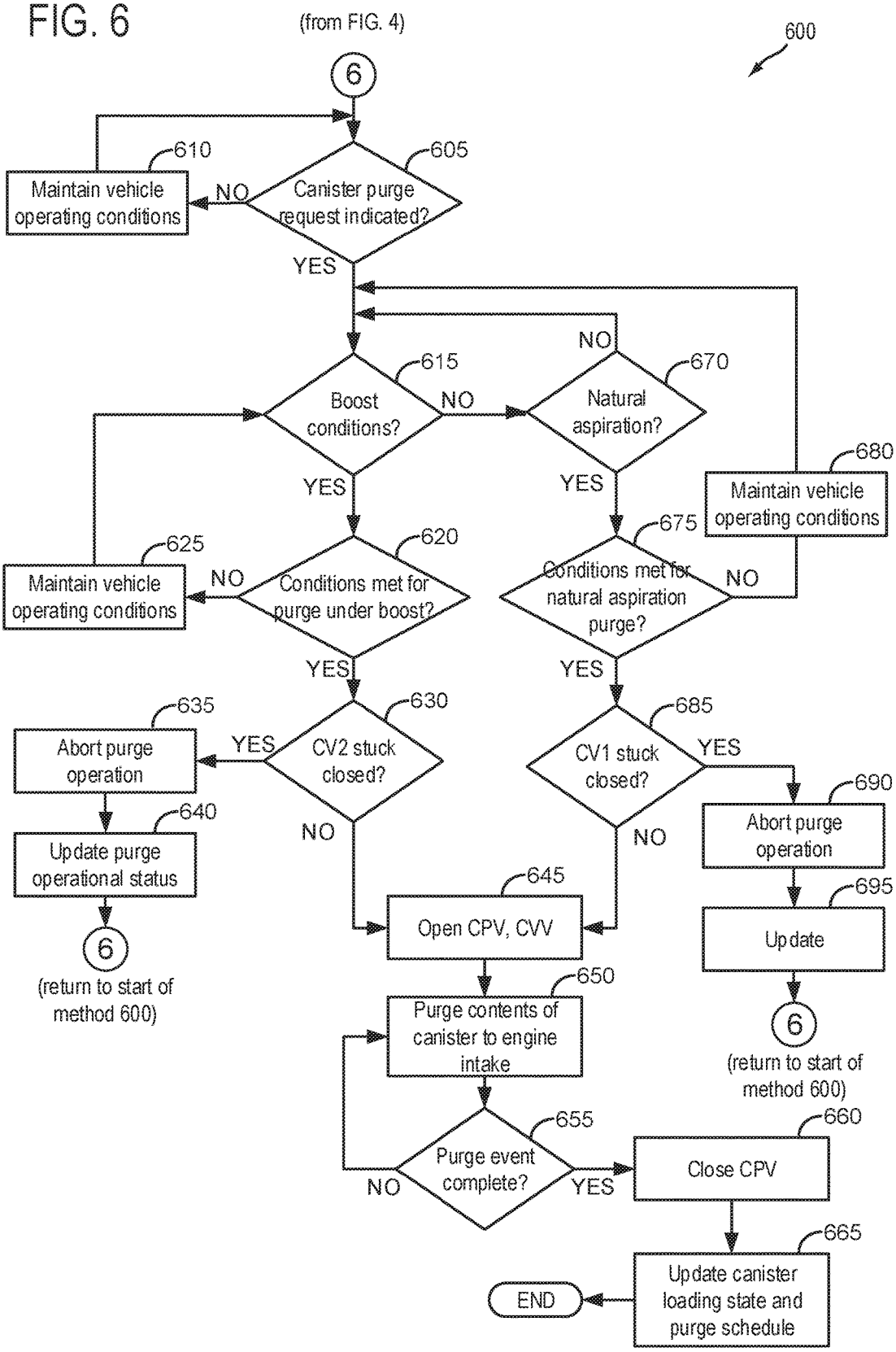
FIG. 6 shows a high-level flowchart for an example method for conducting a fuel vapor canister purging operation, under conditions where one of a first check valve or a second check valve positioned in an evaporative emissions system is indicated to be stuck closed.

Turning now to FIG. 6, a flow chart for a high level example method 600 for conducting fuel vapor canister purging operations, are shown. More specifically, method 600 may proceed from method 400 and may include purging fuel vapors stored in the fuel vapor canister under select engine operating conditions by commanding open a canister purge valve (CPV) and commanding open a canister vent valve (CVV) to draw atmospheric air across the fuel vapor storage canister to desorb fuel vapors. Desorbed fuel vapors may be routed through either a first check valve CV1 (e.g., 153) or a second check valve CV2 (e.g., 170) depending on the engine operating conditions, wherein routing desorbed fuel vapors through the first check valve is discontinued responsive to an indication that the first check valve is stuck substantially closed, and wherein routing desorbed fuel vapors through the second check valve is discontinued responsive to an indication that the second check valve is stuck substantially closed.

Method 600 will be described with reference to the systems described herein and shown in FIG. 1, though it should be understood that similar methods may be applied to other systems without departing from the scope of this disclosure. Method 600 may be carried out by a controller, such as controller 166 in FIG. 1, and may be stored at the controller as executable instructions in non-transitory memory. Instructions for carrying out method 400 and the rest of the methods included herein may be executed by the controller based on instructions stored on a memory of the controller and in conjunction with signals received from sensors of the engine system, such as the sensors described above with reference to FIG. 1. The controller may employ fuel system and evaporative emissions system actuators, such as canister purge valve (CPV) (e.g., 158), canister vent valve (CVV) (e.g., 172), etc., according to the method below.

Method 600 begins at 605 and may include indicating whether a fuel vapor canister purge operation request is indicated during a vehicle drive cycle. A fuel vapor canister purge operation may be requested responsive to conditions being met for a canister purge operation. For example, conditions being met for a canister purge operation may include an indication of an amount of fuel vapor stored in the fuel vapor canister (e.g., 104) greater than a predetermined threshold amount, an estimate or measurement of temperature of an emission control device such as a catalyst being above a predetermined temperature associated with catalytic operation commonly referred to as light-off temperature, etc.

If, at 605, a canister purge event request is not indicated, method 600 may proceed to 610. At 610, method 600 may include maintaining vehicle operating conditions. For example, a status of evaporative emissions system actuators (e.g., CPV, CVV), fuel system actuators (e.g., fuel injectors, etc.), engine operational status (air fuel ratio, spark timing, etc.), may be maintained.

Returning to 605, if a canister purge even request is indicated, method 600 may proceed to 615. At 615, method 600 may include indicating whether the vehicle engine is operating under boost conditions. For example, it may be determined whether manifold air pressure (MAP) is greater than barometric pressure (BP). Such a determination may be indicated via a pressure sensor positioned in an intake manifold (e.g., 115), for example a MAP sensor, and a dedicated barometric pressure sensor (e.g., 119). In other examples, barometric pressure may be indicated via any conventional means. If, at 615 it is indicated that the vehicle engine is operating under boost conditions, method 600 may proceed to 620. At 620, method 600 may include indicating whether conditions are met for a purge under boost. For example, conditions being met for purge under boost conditions may include an indication of MAP greater than BP by a predetermined threshold, and may in some examples further include MAP greater than BP by the predetermined threshold, for a predetermined time duration. If, at 620, conditions are not met for purging under boost, then method 600 may proceed to 625, and may include maintaining vehicle operating conditions. Similar to that described above with regard to step 610, at 625, maintaining vehicle operating conditions may include maintaining a status of evaporative emissions system actuators (e.g. CPV, CVV), fuel system actuators (e.g., fuel injectors, etc.), engine operational status (air fuel ratio, spark timing, etc.), etc.

If, at 620, it is indicated that conditions are met for purging under boost conditions, method 600 may proceed to 630. At 630, method 600 may include indicating whether CV2 (e.g. 170) has been previously indicated to be stuck closed. For example, if the dual test monitor described above with regard to method 400 indicated that CV2 is stuck closed, then method 600 may proceed to 635 and may include aborting the purging operation under boost conditions. More specifically, a stuck closed CV2 may prevent vacuum derived from an ejector (e.g., 140) under boost conditions from reaching the fuel vapor canister. Thus, purging the fuel vapor canister under boost conditions may be rendered ineffective responsive to an indication of a stuck closed CV2. Accordingly, the purging operation may be aborted at 635. Method 600 may then proceed to 640, and may include updating the fuel vapor canister purging operational status. For example, it may be indicated that a canister purge request was indicated and that conditions were met for a boosted purge operation, but that the purge operation was aborted due to a stuck closed CV2. As the boosted purge operation was aborted, method 600 may thus return to the start of method 600.

Returning to step 630, if it is indicated that conditions are met for a purging operation under boost conditions, and CV2 is not indicated to be stuck closed, method 600 may proceed to 645. At 645, method 600 may include commanding open the CPV, and commanding open or maintaining open the CVV. Proceeding to step 650, method 600 may include purging the contents of the fuel vapor canister to engine intake. More specifically, by commanding open the CPV and commanding open or maintaining open the CVV, vacuum derived from the ejector (e.g., 140) under boost conditions may be routed to the fuel vapor canister (e.g., 104), thus drawing atmospheric air through a vent (e.g., 136), and through fuel vapor canister. By drawing atmospheric air across the fuel vapor canister, stored fuel vapor may thus be desorbed and routed to the ejector. As discussed above with regard to FIG. 1, upon entering the ejector, air and fuel vapors may be drawn out of the ejector via an outlet port (e.g., 146) and into an intake (e.g., 118) at a position upstream of a compressor (e.g., 126). Operation of the compressor then may draw the air and fuel vapors through the compressor, and through a charge air cooler (e.g., 156) for delivery to an intake manifold of the engine (e.g., 116).

In some examples, purging the contents of the fuel vapor canister to engine intake may include purging until a stored fuel vapor amount in the canister is below a predetermined threshold canister load. For example, during purging, a learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. More specifically, one or more exhaust gas oxygen sensors (e.g., 125) may be positioned in the engine exhaust to provide an estimate of a canister load (that is, an amount of fuel vapors stored in the canister). Exhaust gas sensor may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Based on the canister load, and further based on engine operating conditions, such as engine speed-load conditions, a purge flow rate may be determined. In one example, purging the canister may include indicating an air/fuel ratio via, for example, a proportional plus integral feedback controller coupled to a two-state exhaust gas oxygen sensor, and responsive to the air/fuel indication and a measurement of inducted air flow, generating a base fuel command. To compensate for purge vapors, a reference air/fuel ratio, related to engine operation without purging, may be subtracted from the air/fuel ratio indication and the resulting error signal (compensation factor) generated. As such, the compensation factor may represent a learned value directly related to fuel vapor concentration, and may be subtracted from the base fuel command to correct for the induction of fuel vapors.

As discussed above with regard to FIG. 1, in other examples one or more oxygen sensors may be positioned in the engine intake (e.g., 116), or coupled to the canister (e.g., 104) (e.g., downstream of the canister), to provide an estimate of canister load. In still further examples, one or more temperature sensors (e.g., 157) may be coupled to and/or within canister (e.g., 104). As fuel vapor is desorbed by the adsorbent in the canister, temperature change may be monitored such that canister load may be estimated based on the temperature change. For example, a temperature decrease during desorption of fuel vapors may be used to estimate canister load.

Accordingly, proceeding to 655, method 600 may include indicating whether the purging event is complete. For example, the purging event may be complete when canister load reaches a predetermined threshold canister load. If, at 655, it is indicated that canister purging is not complete, method 600 may return to 650, and may include continuing to purge the contents of the canister to engine intake. However, if at 655 it is indicated that the purging event is complete, method 600 may proceed to 660. At 660, method 600 may include commanding closed the CPV. By commanding closed the CPV, the purging operation may be terminated, as the fuel vapor canister may be sealed from the ejector and from engine intake.

Proceeding to 665, method 600 may include updating canister loading state responsive to the recent purging event, and updating a canister purge schedule. For example, the canister loading state may be updated at the controller, and the purge schedule updated to reflect the loading state of the fuel vapor canister. Method 600 may then end.

Returning to 615, if a canister purge request is indicated, but the vehicle is not operating under boost conditions, method 600 may proceed to 670. At 670, method 600 may include indicating whether the vehicle is operating under natural aspiration conditions. For example, it may be determined whether MAP is less than BP, for example. As discussed above, such a determination may be indicated via a pressure sensor positioned in an intake manifold (e.g., 115), for example a MAP sensor, and a dedicated barometric pressure sensor (e.g., 119). In other examples, barometric pressure may be indicated via any conventional means. If, at 670 it is indicated that the vehicle engine is operating under natural aspiration conditions, method 600 may proceed to 675. At 675, method 600 may include indicating whether conditions are met for a purge under natural aspiration. For example, conditions being met for purge under natural aspiration conditions may include an indication of MAP less than BP by a predetermined threshold, and may in some examples further include MAP less than BP by the predetermined threshold, for a predetermined time duration. If, at 675, conditions are not met for a purge under natural aspiration conditions, then method 600 may proceed to 680, and may include maintaining vehicle operating conditions. Similar to that described above, at 680, maintaining vehicle operating conditions may include maintaining a status of evaporative emissions system actuators (e.g., CPV, CVV), fuel system actuators (e.g., fuel injectors, etc.), engine operational status (air fuel ratio, spark timing, etc.), etc.

Returning to 675, if it is indicated that conditions are met for a purge operation under natural aspiration conditions, method 600 may proceed to 685. At 685, method 600 may include indicating whether CV1 (e.g., 153) has been previously indicated to be stuck closed. For example, if the dual test monitor described above with regard to method 400 indicated that CV1 is stuck closed, then method 600 may proceed to 690 and may include aborting the purging operation under natural aspiration conditions. More specifically, a stuck closed CV1 may prevent significant vacuum derived from engine intake (e.g. 116) from reaching the fuel vapor canister. Thus, purging the fuel vapor canister under natural aspiration conditions may be rendered ineffective responsive to an indication of a stuck closed CV1. Accordingly, the purging operation may be aborted at 690. Method 600 may then proceed to 695, and may include updating the fuel vapor canister purging operational status. For example, it may be indicated that a canister purge request was indicated and that conditions were met for a natural aspiration purge operation, but that the purge operation was aborted due to a stuck closed CV1. As the natural aspiration purging operation was aborted, method 600 may thus return to the start of method 600.

Returning to step 685, if it is indicated that conditions are met for a purging operation under natural aspiration, and CV1 is not indicated to be stuck closed, method 600 may proceed to 645. Responsive to method 600 reaching step 645 subsequent to the indication that CV1 is not stuck closed, steps 645 through 665 may proceed exactly as described above. Accordingly, to avoid redundancy, steps 645 through 665 will not be reiterated here.

Turning now to FIG. 7, an example timeline 700 for conducting evaporative emissions test diagnostic procedures using a dual test monitor approach, as discussed above with regard to FIG. 4, is shown. Timeline 700 includes plot 705, indicating whether a key-on event is indicated, over time. Timeline 700 further includes plot 710, indicating manifold air pressure (MAP) with respect to barometric pressure (BP), where BP is represented by line 711. Line 712 represents a first threshold MAP amount below BP, wherein when the first threshold is reached, an evaporative emissions test diagnostic procedure may be conducted under natural aspiration conditions. Line 713 represents a second threshold MAP amount above BP, wherein when the second threshold is reached, an evaporative emissions test diagnostic procedure may be conducted under boost conditions. Timeline 700 further includes plot 715, indicating whether a canister purge valve (CPV) (e.g., 158) is open or closed, and plot 720, indicating whether a canister vent valve (CVV) (e.g., 172) is open or closed, over time. Timeline 700 further includes plot 725, indicating pressure (atmospheric pressure, abbreviated Atm., and negative pressure (vacuum) with respect to atmospheric pressure, abbreviated Vac.) in an evaporative emissions system (e.g., 154) and fuel system (e.g., 106), as indicated by a fuel tank pressure transducer (FTPT) (e.g., 107), for example, over time. Line 726 represents a predetermined threshold vacuum, which, if reached during an evaporative emissions test diagnostic procedure, may indicate an absence of gross undesired evaporative emissions. Line 727 represents a predetermined threshold pressure, which, if reached subsequent to reaching the predetermined threshold vacuum and subsequent to sealing the fuel system and evaporative emissions system from engine intake and atmosphere, may indicate the presence of non-gross undesired evaporative emissions.

Timeline 700 further includes plot 730, indicating whether a first check valve (CV1) (e.g., 153) is indicated to be stuck closed (yes) or not (no), and plot 735, indicating whether a second check valve (CV2) (e.g., 170) is indicated to be stuck closed (yes) or not (no), over time. Timeline 700 may further include plot 740, indicating whether gross undesired evaporative emissions are present in the evaporative emissions system and/or fuel system, over time. For example, gross undesired evaporative emissions may correspond to a predetermined orifice diameter of 0.04", or greater. Timeline 700 further includes plot 745, indicating whether non-gross undesired evaporative emissions are present in the evaporative emissions system and/or fuel system, over time. For example, non-gross undesired evaporative emissions may correspond to a predetermined orifice diameter substantially smaller than the predetermined orifice diameter corresponding to gross undesired evaporative emissions.

At time t0, the vehicle is not in operation, as indicated by plot 705. Accordingly, MAP is indicated to be at BP, indicated by plot 710, as the engine is not operating. The CPV closed, indicated by plot 715, and the CVV is open, indicated by plot 720. With the CVV open, the fuel system and evaporative emissions are not sealed from atmosphere, and thus a pressure sensor (FTPT) (e.g. 107) positioned between the fuel system and the evaporative emissions system, indicates atmospheric pressure, indicated by plot 725. CV1 (e.g., 153) is not indicated to be stuck closed, indicated by plot 730, and CV2 (e.g., 170) is also not indicated to be stuck closed, indicated by plot 735. Furthermore, gross undesired evaporative emissions are not indicated, illustrated by plot 740, and non-gross undesired evaporative emissions are not indicated, illustrated by plot 745.

At time t1, a key-on event is indicated. In this example timeline 700, it may be understood that the key-on event includes an engine-on event. Between time t1 and t2, MAP is indicated to decrease relative to BP, the result of engine operation. More specifically, while the engine is in operation (e.g., combusting fuel), the coordinated opening and closing of cylinder intake valve(s) and exhaust valve(s) may result in intake manifold vacuum (MAP lower than BP).

At time t2, MAP is indicated to reach the first threshold. Accordingly, conditions may be met for conducting an evaporative emissions test diagnostic procedure that includes evacuating the evaporative emissions system and fuel system via natural aspiration (intake manifold vacuum). Accordingly, the CPV is commanded open, and the CVV is commanded closed. With the CVV commanded closed, the fuel system and evaporative emissions system may be sealed from atmosphere. By commanding open the CPV, the evaporative emissions system and fuel system may be communicatively coupled (fluidically coupled) to engine intake (e.g., 116).

Between time t2 and t3, with the CPV open and the CVV closed, pressure in the fuel system and evaporative emissions system drops (vacuum develops), indicated by plot 725. In other words, pressure in the fuel system and evaporative emissions system is lowered with respect to atmospheric pressure. At time t3, pressure in the fuel system and evaporative emissions system is indicated to reach the predetermined threshold vacuum. Accordingly, because the predetermined threshold vacuum was reached, gross undesired evaporative emissions are not indicated, illustrated by plot 740, and CV1 is not indicated to be stuck closed, illustrated by plot 730. Such results may be stored at the controller (e.g., 166), as discussed above with regard to FIG. 3 and FIG. 4. However, while CV2 is not indicated to be stuck closed, it may not be conclusively determined that CV2 is not stuck closed, as described in detail above.

At time t3, responsive to the predetermined threshold vacuum being reached, the CPV is commanded closed, and the CVV is maintained closed. Accordingly, the fuel system and evaporative emissions system may be sealed from engine intake and atmosphere. Pressure in the fuel system and evaporative emissions system may thus be monitored for a predetermined duration, in order to indicate the presence or absence of non-gross undesired evaporative emissions. Accordingly, between time t3 and t4, pressure bleed-up in the fuel system and evaporative emissions system is monitored, as indicated by plot 725. By time t4, pressure bleed-up is indicated to have remained below the predetermined threshold pressure, represented by line 727. Accordingly, no non-gross undesired evaporative emissions are indicated in the fuel system and evaporative emissions system.

At time t4, the CVV is commanded open. With the CVV commanded open and the CPV closed, pressure in the fuel system and evaporative emissions system returns to atmospheric pressure between time t4 and t5, illustrated by plot 725.

Furthermore, between time t4 and t5, engine operation maintains MAP below BP. However, at time t5, MAP is indicated to equal BP. Between time t5 and t6, MAP continues to increase with respect to BP, illustrated by plot 710. In other words, it may be understood that between time t5 and t6, the engine is operating under boost conditions, described in detail above.

At time t6, MAP is indicated to be above BP by the second threshold amount. Accordingly, an evaporative emissions test diagnostic procedure may be conducted under boost conditions. Thus, at time t6, the CPV is again commanded open, and the CVV is again commanded closed. As discussed above with regard to FIG. 2 and FIG. 4, while the engine is operating under boost conditions, and when the CVV is commanded closed and the CPV is commanded open, vacuum derived from the ejector (e.g., 140) may be communicated to the sealed evaporative emissions system and fuel system. However, between time t6 and t7, though MAP remains above BP by the threshold amount, vacuum with respect to atmospheric pressure is not indicated to build in the fuel system and evaporative emissions system, illustrated by plot 725. Accordingly, at time t7, it is indicated that CV2 (e.g., 170) is stuck closed, and gross undesired evaporative emissions are not indicated. In other words, example timeline 700 may thus represent outcome D, as described above with regard to lookup table 500 depicted above at FIG. 5. More specifically, at time t7, the results from the evaporative emissions test diagnostic conducted under natural aspiration and the results of the evaporative emissions test diagnostic conducted under boost may be analyzed by the controller, and interpreted via, for example, a lookup table stored at the controller, such as lookup table 500 depicted at FIG. 5. As the CV2 was indicated to be stuck closed at time t7, a MIL may be illuminated on a dash of the vehicle, alerting the vehicle operator of the stuck CV2. Furthermore, at time t7, responsive to completion of the dual test monitor, CPV may be commanded closed and the CVV may be commanded open. Accordingly, with the CVV open, pressure in the fuel system and evaporative emissions system returns to atmospheric pressure between time t7 and t8, indicated by blot 725.

Turning now to FIG. 8, an example timeline 800 for conducting a purging event under conditions where one of a first check valve or a second check valve positioned in an evaporative emissions system is indicated to be stuck closed, is shown. In this example illustration, it may be understood that CV1 has been indicated to be stuck closed. Timeline 800 includes plot 805, indicating whether a fuel vapor canister purging request is indicated, over time. Timeline 800 further includes plot 810, indicating manifold air pressure (MAP) with respect to barometric pressure (BP), where BP is represented by line 811, over time. Timeline 800 further includes plot 815, indicating an open or closed state of a canister purge valve (e.g., 158), and plot 820, indicating an open or closed state of a canister vent valve (CVV) (e.g., 172), over time. Timeline 800 further includes plot 825, indicating whether a first check valve (CV1) (e.g., 153) is stuck closed, and plot 830, indicating whether a second check valve (CV2) (e.g., 170) is stuck closed, over time. Timeline 800 further includes plot 835, indicating a canister loading state of a fuel vapor canister (e.g., 104), over time. Line 836 represents a threshold canister loading state, wherein, if reached during a purging event, the purging event may be indicated to be complete.

At time t0, it may be understood that the vehicle is in operation, and that no request for purging the fuel vapor canister has been indicated. MAP is negative with respect to BP, indicated by plot 810. In other words, it may be understood that the engine is operating under natural aspiration. As a canister purging operation is not being conducted, the CPV is indicated to be closed, illustrated by plot 815, and the CVV is indicated to be open, illustrated by plot 820. With the CPV closed, a fuel system (e.g., 106) and evaporative emissions system (e.g., 154) may be sealed from engine intake, as discussed above. With the CVV open, the fuel system and evaporative emissions system may be communicatively coupled (fluidically coupled) to atmosphere. As the CVV is open, fuel vapors generated in the fuel tank during vehicle operating conditions (e.g., running loss fuel vapors) may be directed to the fuel vapor canister for storage, prior to exiting to atmosphere. Accordingly, between time t0 and t1, while the engine is in operation, a canister loading state is indicated to increase slightly. As discussed above, in some examples a temperature sensor (e.g., 157) positioned within the fuel vapor canister may be used to infer canister loading state.

At time t1, a purging request is indicated. In some examples, the request for purging may include a canister loading state above a threshold level (not shown), a level of vacuum in the intake manifold greater than a threshold vacuum level (not shown), etc. However, even though a purging request is indicated at time t1, because CV1 has been indicated previously to be stuck closed, the CPV may remain closed, and the CVV may remain open. In other words, the purging operation under natural aspiration may be prevented (e.g., aborted). More specifically, CV1 may have been indicated to be stuck closed responsive to running a dual test monitor on the fuel system and evaporative emissions system, such as the dual test monitor depicted in detail above with regard to FIG. 4. As CV1 is indicated to be stuck closed, the purging operation may be prevented, as the stuck closed CV1 may render the purging operation ineffective. Accordingly, between time t1 and t2, vehicle operating conditions are maintained, without conducting a purging operation.

At time t2, MAP is indicated to be equal to BP, and between time t2 and t3, MAP becomes greater than BP. Thus, it may be understood that the engine is operating under boosted conditions between time t2 and t3. At time t3, conditions are indicated to be met for a purging operation under boost conditions. For example, conditions being met for a purging operation under boost may include MAP above BP by a predetermined threshold (not shown), for a predetermined time duration (not shown). Conditions being met for a purging operation under boost may further include canister load above a predetermined threshold canister load (not shown), for example. Conditions being met for a purging operation under boost may further include an indication that CV2 is not stuck closed. Accordingly, at time t3, the CPV is commanded open, indicated by plot 815. As discussed above, by commanding open the CPV at time t3, vacuum derived from an ejector (e.g., 140) during boost conditions may be applied to the fuel vapor canister. By applying vacuum to the fuel vapor canister with the CPV open and the CVV open, atmospheric air may be drawn across the fuel vapor canister, thus desorbing fuel vapors stored in the fuel vapor canister.

Between time t3 and t4, canister loading state is indicated to decrease. Canister loading state may be indicated via any of the methods described above with respect to FIG. 5, for example. At time t4, canister loading state is indicated to reach the threshold canister loading state, represented by line 836. Thus, it may be indicated that the fuel vapor canister is substantially free of fuel vapors. In other words, it may be indicated that the fuel vapor canister is clean. Because the canister is indicated to be clean, the CPV is commanded closed at time t4, and the purging request is terminated.

Between time t4 and t5, the vehicle remains in operation, and MAP fluctuates, equaling BP at time t5. Between time t5 and t6, the engine is again operating under natural aspiration conditions, indicated by plot 810.

In this way, in a vehicle with a boosted engine, a plurality of components may be conclusively diagnosed in a single drive cycle, in addition to simultaneously testing for the presence or absence of undesired evaporative emissions in a fuel system and evaporative emissions system of the vehicle. For example, as discussed above, under non-boosted condition, it may be difficult to determine if a first check valve positioned downstream of a canister purge valve and upstream of an intake manifold is stuck closed, or if there are undesired evaporative emissions present in the fuel system and/or evaporative emissions system. Similarly, under boosted conditions, it may be difficult to determine if a second check valve positioned downstream of the canister purge valve and upstream of an ejector, is stuck closed or if undesired evaporative emissions are present in the fuel system and/or evaporative emissions control system. By conducting an evaporative emissions test diagnostic procedure under both boosted and non-boosted conditions in the same drive cycle, it may be unambiguously determined whether undesired evaporative emissions are present in the fuel system and/or evaporative emissions system, or whether either the first check valve, or the second check valve, are stuck closed.

The technical effect of unambiguously determining whether undesired evaporative emissions are present in a vehicle fuel system and/or evaporative emissions system, or whether one of a first check valve, or a second check valve are stuck closed, is to conduct an evaporative emissions test diagnostic procedure under boost conditions and under natural aspiration conditions in the same drive cycle (e.g., a dual test monitor). By conducting a dual test monitor, results of the test under boost conditions may be compared to results of the test under natural aspiration. By comparing the test results under boost conditions to the test results under natural aspiration, undesired evaporative emissions may not be indicated when a check valve is stuck closed, for example, and vice versa. Pinpointing the reason for an inability to achieve a predetermined vacuum threshold level during conducting the dual test monitor may thus reduce undesired evaporative emissions, may result in greater vehicle operator satisfaction, and may reduce the time needed to service the vehicle.

The systems described herein and with reference to FIG. 1, along with the methods described herein and with reference to FIGS. 2-4, and FIG. 6, may enable one or more systems and one or more methods. In one example, a method for a vehicle comprises evacuating a fuel system, including a fuel tank that supplies fuel to an engine, and an evaporative emissions system, including a fuel vapor storage canister for storing vapors from the tank, under a first condition and a second condition during a single drive cycle; and diagnosing a plurality of fuel system and evaporative emissions system components based on a vacuum level reached during both the first and second conditions. In a first example of the method, the method further includes wherein the single drive cycle includes a duration of time between a key-on event and a key-off event. A second example of the method optionally includes the first example and further includes wherein the first condition includes pressure in an intake manifold of the engine less than barometric pressure; and wherein the second condition includes pressure in the intake manifold of the engine greater than barometric pressure. A third example of the method optionally includes any one or more or each of the first and second examples and further includes wherein evacuating the fuel system and evaporative emissions system further comprises: communicatively coupling the fuel system and evaporative emissions system to the intake manifold of the engine in the first condition; and communicatively coupling the fuel system and evaporative emissions system to an ejector in an ejector system of the vehicle, wherein the ejector functions to generate negative pressure in the fuel system and evaporative emissions system, in the second condition. A fourth example of the method optionally includes any one or more or each of the first through third examples and further includes wherein communicatively coupling the fuel system and evaporative emissions to the intake manifold of the engine in the first condition, and communicatively coupling the fuel system and evaporative emissions system to the ejector in the second condition includes commanding open a canister purge valve positioned downstream of the fuel vapor canister, and upstream of both the ejector and the intake manifold of the engine. A fifth example of the method optionally includes any one or more or each of the first through fourth examples and further includes wherein communicatively coupling the fuel system and evaporative emissions system to the intake manifold in the first condition includes opening a first check valve positioned upstream of the intake manifold; wherein communicatively coupling the fuel system and evaporative emissions system to the ejector in the second condition includes opening a second check valve positioned upstream of the ejector; and wherein both the first check valve and the second check valve comprise vacuum-actuated valves. A sixth example of the method optionally includes any one or more or each of the first through fifth examples and further includes wherein diagnosing the plurality of fuel system and evaporative emissions system components based on the vacuum level reached during both the first and second conditions includes diagnosing both the first check valve and the second check valve. A seventh example of the method optionally includes any one or more or each of the first through sixth examples and further comprises responsive to the vacuum level reaching a predetermined threshold vacuum level in the first condition, indicating the first check valve is not stuck closed; and responsive to the vacuum level reaching the predetermined threshold vacuum level in the second condition, indicating the second check valve is not stuck closed. An eighth example of the method optionally includes any one or more or each of the first through seventh examples and further includes wherein responsive to the vacuum level reaching the predetermined vacuum level in at least one of the first condition and the second condition: indicating an absence of gross undesired evaporative emissions in the fuel system and evaporative emissions system. A ninth example of the method optionally includes any one or more or each of the first through eighth examples and further includes wherein responsive to the vacuum level reaching the predetermined vacuum level in only one condition, indicating the absence of gross undesired evaporative emissions in the fuel system and evaporative emissions system; and indicating one check valve is stuck closed. A tenth example of the method optionally includes any one or more or each of the first through ninth examples and further includes wherein responsive to the vacuum level not reaching the predetermined vacuum level in either the first condition or the second condition: indicating the presence of gross undesired evaporative emissions in the fuel system and/or evaporative emissions system. An eleventh example of the method optionally includes any one or more or each of the first through tenth examples and further includes wherein evacuating the fuel system and evaporative emissions system further comprises: sealing the fuel system and evaporative emissions system from atmosphere in both the first condition and the second condition.

Another example of a method for a vehicle comprises supplying fuel from a fuel system to an engine during a single drive cycle which comprises a duration between a key-on event and a key-off event; storing fuel vapors from the fuel system in an evaporative emissions system removably coupled to the fuel system; during the single drive cycle, evacuating the fuel system and evaporative emissions system through a first check valve in a first condition; during the single drive cycle, evacuating the fuel system and evaporative emissions system through a second check valve in a second condition; and indicating the presence or absence of gross undesired evaporative emissions in the fuel system and/or evaporative emissions system, and indicating whether one of the first check valve or the second check valve is stuck substantially closed, based on a vacuum level reached during the evacuating of the fuel system and evaporative emissions system in both the first condition and the second condition. In a first example of the method, the method further comprises indicating the second check valve is stuck substantially closed when a predetermined negative pressure is not reached when evacuating the fuel system and evaporative emission system during a boosted mode of engine operation but is reached when reducing pressure during a natural aspirated mode of engine operation; and indicating the first check valve is stuck substantially closed when a predetermined negative pressure is not reached when evacuating the fuel system and evaporative emission system during the natural aspirated mode of engine operation but is reached when reducing pressure during the boosted mode of engine operation. A second example of the method optionally includes the first example and further includes wherein the fuel system and evaporative emission system are coupled to a compressor inlet through an orifice having an inlet pressure reduced by a venturing effect. A third example of the method optionally includes any one or more or each of the first and second examples and further comprises testing for presence or absence of non-gross undesired evaporative emissions by comparing a pressure change in the fuel system or evaporative emission system to a reference pressure change after evacuating the fuel system and evaporative emissions system in both the first and second condition. A fourth example of the method optionally includes any one or more or each of the first through third examples and further comprises selectively coupling the fuel system and evaporative emission system to atmosphere via a canister vent valve positioned between a fuel vapor storage canister in the evaporative emission system and atmosphere; selectively coupling the fuel system and evaporative emissions system to an intake manifold of the engine via a canister purge valve positioned between the fuel vapor storage canister and the first and second check valves; and in both the first and second conditions, sealing the fuel system and evaporative emissions system from atmosphere by commanding closed the canister vent valve, and coupling the fuel system and evaporative emission system to the intake manifold by commanding open the canister purge valve. A fifth example of the method optionally includes any one or more or each of the first through fourth examples and further comprises purging fuel vapors stored in the fuel vapor canister under select engine operating conditions by commanding open the canister purge valve and commanding open the canister vent valve to draw atmospheric air across the fuel vapor storage canister to desorb fuel vapors; wherein desorbed fuel vapors are routed through either the first check valve or the second check valve depending on the engine operating conditions; wherein routing desorbed fuel vapors through the first check valve is discontinued responsive to an indication that the first check valve is stuck substantially closed; and wherein routing desorbed fuel vapors through the second check valve is discontinued responsive to an indication that the second check valve is stuck substantially closed.

An example of a system for a vehicle comprises a fuel system including a fuel tank, the fuel tank communicatively coupled to an evaporative emissions system comprising a fuel vapor canister; a canister vent valve, positioned in a vent line that couples the fuel vapor canister to atmosphere; a canister purge valve, positioned in purge line stemming from the fuel vapor canister; a first check valve, positioned in a first conduit downstream of the canister purge valve, where the first conduit connects the purge line to an intake manifold of a vehicle engine; a second check valve, positioned in the purge line downstream of the canister purge valve and further downstream of the first conduit; an ejector system, positioned downstream of the second check valve; a compressor, positioned in an intake passage upstream of an air intake throttle, the air intake throttle positioned in the intake passage upstream of the intake manifold; a fuel tank pressure transducer positioned between the fuel tank and the fuel vapor canister; and a controller storing instructions in non-transitory memory, that when executed, cause the controller to: in a first condition where pressure in the intake manifold is less than barometric pressure, command closed the canister vent valve, command open the canister purge valve, and monitor pressure in the fuel system and evaporative emissions system; in a second condition where the compressor is activated and where pressure in the intake manifold is greater than barometric pressure, command closed the canister vent valve, command open the canister purge valve, and monitor pressure in the fuel system and evaporative emissions system; and indicate a presence or absence of gross undesired evaporative emissions in the fuel system and evaporative emissions system, and whether either the first check valve or second check valve is stuck closed, based on a vacuum level reached during monitoring pressure in the fuel system and evaporative emissions system in both the first and the second condition during a single drive cycle. In a first example, the system further includes wherein the controller further stores instructions in non-transitory memory, that when executed, cause the controller to: indicate the absence of gross undesired evaporative emissions and indicate that both the first check valve and the second check valve are not stuck closed responsive to vacuum level during both the first condition and the second condition reaching a predetermined threshold vacuum level; indicate the absence of gross undesired evaporative emissions and indicate that one of the first check valve or the second check valve is stuck closed responsive to vacuum level during the first condition and the second condition reaching the predetermined threshold vacuum level in only one of the first condition or the second condition; and indicate the presence of gross undesired evaporative emissions responsive to vacuum level during the first condition and the second condition not reaching the predetermined threshold vacuum level in both the first condition and the second condition.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle comprising:

evacuating a fuel system, including a fuel tank that supplies fuel to an engine, and an evaporative emissions system, including a fuel vapor storage canister for storing vapors from the tank, under a first condition and a second condition through respective first and second check valves during a single drive cycle;

diagnosing a plurality of fuel system and evaporative emissions system components based on a vacuum level reached during both the first and second conditions;

responsive to the vacuum level reaching a predetermined threshold vacuum level in the first condition, indicating the first check valve is not stuck closed; and responsive to the vacuum level reaching the predetermined threshold vacuum level in the second condition, indicating the second check valve is not stuck closed.

2. The method of claim 1, wherein the single drive cycle includes a duration of time between a key-on event and a key-off event.

3. The method of claim 1, wherein the first condition includes pressure in an intake manifold of the engine less than barometric pressure; and wherein the second condition includes pressure in the intake manifold of the engine greater than barometric pressure.

4. The method of claim 3, wherein evacuating the fuel system and evaporative emissions system further comprises:

communicatively coupling the fuel system and evaporative emissions system to the intake manifold of the engine in the first condition; and communicatively coupling the fuel system and evaporative emissions system to an ejector in an ejector system of the vehicle, wherein the ejector functions to generate negative pressure in the fuel system and evaporative emissions system, in the second condition.

5. The method of claim 4, wherein communicatively coupling the fuel system and evaporative emissions to the intake manifold of the engine in the first condition, and communicatively coupling the fuel system and evaporative emissions system to the ejector in the second condition includes commanding open a canister purge valve positioned downstream of the fuel vapor canister, and upstream of both the ejector and the intake manifold of the engine.

6. The method of claim 4, wherein communicatively coupling the fuel system and evaporative emissions system to the intake manifold in the first condition includes opening the first check valve positioned upstream of the intake manifold;

wherein communicatively coupling the fuel system and evaporative emissions system to the ejector in the second condition includes opening the second check valve positioned upstream of the ejector; and wherein both the first check valve and the second check valve comprise vacuum-actuated valves.

7. The method of claim 6, wherein diagnosing the plurality of fuel system and evaporative emissions system components based on the vacuum level reached during both the first and second conditions includes diagnosing both the first check valve and the second check valve.

8. The method of claim 7, wherein responsive to the vacuum level reaching the predetermined vacuum level in at least one of the first condition and the second condition:

indicating an absence of gross undesired evaporative emissions in the fuel system and evaporative emissions system.

9. The method of claim 8, wherein responsive to the vacuum level reaching the predetermined vacuum level in only one condition, indicating the absence of gross undesired evaporative emissions in the fuel system and evaporative emissions system; and indicating one check valve is stuck closed.

10. The method of claim 7, wherein responsive to the vacuum level not reaching the predetermined vacuum level in either the first condition or the second condition:

indicating a presence of gross undesired evaporative emissions in the fuel system and/or evaporative emissions system.

11. The method of claim 1, wherein evacuating the fuel system and evaporative emissions system further comprises:

sealing the fuel system and evaporative emissions system from atmosphere in both the first condition and the second condition.

12. A method for a vehicle comprising:

supplying fuel from a fuel system to an engine during a single drive cycle which comprises a duration between a key-on event and a key-off event;

storing fuel vapors from the fuel system in an evaporative emissions system removably coupled to the fuel system;

during the single drive cycle, evacuating the fuel system and evaporative emissions system through a first check valve in a first condition;

during the single drive cycle, evacuating the fuel system and evaporative emissions system through a second check valve in a second condition; and indicating a presence or absence of gross undesired evaporative emissions in the fuel system and/or evaporative emissions system, and indicating whether one of the first check valve or the second check valve is stuck substantially closed, based on a vacuum level reached during the evacuating of the fuel system and evaporative emissions system in both the first condition and the second condition.

13. The method of claim 12 further comprising indicating the second check valve is stuck substantially closed when a predetermined negative pressure is not reached when evacuating the fuel system and evaporative emissions system during a boosted mode of engine operation but is reached when reducing pressure during a natural aspirated mode of engine operation; and indicating the first check valve is stuck substantially closed when the predetermined negative pressure is not reached when evacuating the fuel system and evaporative emissions system during the natural aspirated mode of engine operation but is reached when reducing pressure during the boosted mode of engine operation.

14. The method of claim 12, wherein the fuel system and evaporative emissions system are coupled to a compressor inlet through an orifice having an inlet pressure reduced by a venturi effect.

15. The method of claim 12 further comprising testing for a presence or absence of non-gross undesired evaporative emissions by comparing a pressure change in the fuel system or evaporative emissions system to a reference pressure change after evacuating the fuel system and evaporative emissions system in both the first and second condition.

16. The method of claim 12, further comprising:

selectively coupling the fuel system and evaporative emissions system to atmosphere via a canister vent valve positioned between a fuel vapor storage canister in the evaporative emissions system and atmosphere;

selectively coupling the fuel system and evaporative emissions system to an intake manifold of the engine via a canister purge valve positioned between the fuel vapor storage canister and the first and second check valves; and in both the first and second conditions, sealing the fuel system and evaporative emissions system from atmosphere by commanding closed the canister vent valve, and coupling the fuel system and evaporative emissions system to the intake manifold by commanding open the canister purge valve.

17. The method of claim 16, further comprising:

purging fuel vapors stored in the fuel vapor canister under select engine operating conditions by commanding open the canister purge valve and commanding open the canister vent valve to draw atmospheric air across the fuel vapor storage canister to desorb fuel vapors;

wherein desorbed fuel vapors are routed through either the first check valve or the second check valve depending on the engine operating conditions;

wherein routing desorbed fuel vapors through the first check valve is discontinued responsive to an indication that the first check valve is stuck substantially closed; and wherein routing desorbed fuel vapors through the second check valve is discontinued responsive to an indication that the second check valve is stuck substantially closed.

18. A system for a vehicle, comprising:

a fuel system including a fuel tank, the fuel tank communicatively coupled to an evaporative emissions system comprising a fuel vapor canister;

a canister vent valve, positioned in a vent line that couples the fuel vapor canister to atmosphere;

a canister purge valve, positioned in a purge line stemming from the fuel vapor canister;

a first check valve, positioned in a first conduit downstream of the canister purge valve, where the first conduit connects the purge line to an intake manifold of a vehicle engine;

a second check valve, positioned in the purge line downstream of the canister purge valve and further downstream of the first conduit;

an ejector system, positioned downstream of the second check valve;

a compressor, positioned in an intake passage upstream of an air intake throttle, the air intake throttle positioned in the intake passage upstream of the intake manifold;

a fuel tank pressure transducer positioned between the fuel tank and the fuel vapor canister; and a controller storing instructions in non-transitory memory, that when executed, cause the controller to:

in a first condition where pressure in the intake manifold is less than barometric pressure, command closed the canister vent valve, command open the canister purge valve, and monitor pressure in the fuel system and evaporative emissions system;

in a second condition where the compressor is activated and where pressure in the intake manifold is greater than barometric pressure, command closed the canister vent valve, command open the canister purge valve, and monitor pressure in the fuel system and evaporative emissions system; and indicate a presence or absence of gross undesired evaporative emissions in the fuel system and evaporative emissions system, and whether either the first check valve or second check valve is stuck closed, based on a vacuum level reached during monitoring pressure in the fuel system and evaporative emissions system in both the first and second conditions during a single drive cycle.

19. The system of claim 18, wherein the controller further stores instructions in non-transitory memory, that when executed, cause the controller to:

indicate the absence of gross undesired evaporative emissions and indicate that both the first check valve and the second check valve are not stuck closed responsive to the vacuum level during both the first condition and the second condition reaching a predetermined threshold vacuum level;

indicate the absence of gross undesired evaporative emissions and indicate that one of the first check valve or the second check valve is stuck closed responsive to the vacuum level during the first condition and the second condition reaching the predetermined threshold vacuum level in only one of the first condition or the second condition; and indicate the presence of gross undesired evaporative emissions responsive to the vacuum level during the first condition and the second condition not reaching the predetermined threshold vacuum level in both the first condition and the second condition.

* * * * *